US006133930A

United States Patent [19]

Shibuki et al.

[11] Patent Number: 6,133,930

[45] **Date of Patent: *Oct. 17, 2000**

[54] THERMAL TRANSFER RECORDING APPARATUS

[75] Inventors: Takashi Shibuki; Shoji Kondo, both of Toyokawa, Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/949,877

[22] Filed: Oct. 14, 1997

[30] Foreign Application Priority Data

| | | | |
|---|---|---|---|
| Oct. 16, 1996 | [JP] | Japan | 8-273605 |
| Oct. 30, 1996 | [JP] | Japan | 8-288305 |
| May 29, 1997 | [JP] | Japan | 9-140589 |

[51] Int. Cl.[7] ..... B41J 2/36

[52] U.S. Cl. ..... 347/188; 347/192

[58] Field of Search ..... 347/188, 192, 347/212; 400/120.18, 120.12

[56] References Cited

U.S. PATENT DOCUMENTS

| | | | |
|---|---|---|---|
| 5,220,350 | 6/1993 | Fujii | 347/194 |
| 5,365,257 | 11/1994 | Minowa et al. | 347/189 |
| 5,392,059 | 2/1995 | Ueno et al. | 347/188 |

*Primary Examiner*—N. Le
*Assistant Examiner*—Anh T. N. Vo
*Attorney, Agent, or Firm*—Sidley & Austin

[57] ABSTRACT

A thermal transfer recording apparatus for thermally transferring a film of a transparent resin as a top coat layer to an image formed surface of a recording paper, includes a thermal head which generates heat in proportion to a supplied energy, and a control unit to keep the supplied energy under control such that the energy supplied during an application of film to an initial area of recording paper extending a length from the starting position of an application of the supplied energy, is greater than a supplied energy during an application of film to remaining areas of the recording paper. The apparatus promptly obtains the temperature appropriate for the transfer of film and faultlessly transfers the film to the recording paper, including an initial printing area of such recording paper.

16 Claims, 29 Drawing Sheets

THERMAL TRANSFER RECORDING APPARATUS

BACKGROUND OF THE INVENTION

1. Field of the Invention

This invention relates to a thermal transfer recording apparatus, which is improved in terms of the method for transfer of a top coat layer from an ink film.

2. Description of the Related Art

The thermal transfer recording apparatus is provided with a platen roller and a thermal head as a heating element, which is freely pressed against and separated from the platen roller, and conveys a recording paper through the contacting surface between the platen roller and the thermal head. An ink film which has, for example, an ink with sublimating properties applied to one surface is conveyed into the contacting surface between the recording paper and the thermal head. This ink film is unwound from a supply reel and wound on a take-up reel.

An ink film, which has ink layers in colors such as yellow, magenta and cyan, and a top coat layer sequentially applied in the order on the surface of a film base, is used when single thermal head is operated for reproducing a color image on a recording paper. And the ink film produces a color print by the overlapping of monochromatic images.

The top coat layer is a layer formed by thermally transferring a top coating agent as a laminating resin onto the recording paper at the final stage of printing for the purpose of covering a printed area on the recording paper and preventing the printed area from fading. The recording apparatus of this kind is designed to transfer the top coat layer of a size slightly larger than the printed area, or the image area on the recording paper.

Incidentally, the ink layers in yellow, magenta, cyan, etc. are formed of subliming dyes. The ink layers are transferred by virtue of sublimation (diffusion). Accordingly, there is practically no possibility that defective transfer occurs. In contrast, the top coat layer is formed of a transparent resin. The top coat transfer requires being infallibly adhered to the recording paper at a suitable temperature. It is, however, difficult to fulfil the requirement. Thus, the top coat layer at times fails to be perfectly transferred to the recording paper because the desired temperature of the thermal head for transferring the top coat layer cannot be kept constant to the initial area on which the top coat layer is applied.

In the conventional recording paper, the background area other than the image area is nearly always in a white color. So long as the top coat layer is transferred in a size slightly larger than the image area, therefore, any portion of only nominal defective transfer is not prominent and is incapable of seriously affecting the quality of the finished print because It is located in the white background area.

Recently, a shop such as a processing laboratory, which prints out photographs, deals with a so-called index print, which reproduces the information recorded in a plurality of frames of a negative film on single recording paper. This index print is occasionally required to impart colors to the background area other than the image area. In this case, the defective top coat transfer appears conspicuous to the extent of posing a problem.

The thickness of the recording paper on the lateral edge of the recording paper laid on the platen roller results in the formation of a gap in an area enclosed by the outer periphery of the platen roller, the edge of the recording paper and the top coat layer. The gap has such problems as inhibiting perfect transmission of the heat from the thermal head and inducing defective top coat transfer in the edge area of the top coat layer opposite the vicinities of the lateral edge of the recording paper.

A recording paper, which has such a half-cut thickness line like a sheet of separable and self-adhesive labels or printed matter, is occasionally used. The recording paper similarly produces a gap on the half-cut line. The gap inhibits perfect transfer of heat and induces defective top coat transfer to the recording paper behind the half-cut line, namely in the image area on the downstream side in the direction of printing.

SUMMARY OF THE INVENTION

An object of this invention is to provide a thermal transfer recording apparatus which faultlessly transfers a film as a top coat layer on a recording paper, specially, in the initial area of formation of the top coat layer, the edge of the top coat layer opposite the lateral edge of the recording paper, and an area approximating closely to a half-cut line.

The invention, which accomplishes the object, concerns a thermal transfer recording apparatus for thermally transferring a film of a transparent resin as a top coat layer to an image formed surface of a recording paper, which comprises a thermal head which generates heat in proportion to a supplied energy, and a control unit which keeps the supplied energy under control such that the energy supplied to the thermal head during an application of the film to an initial area of the recording paper extending to a length from a position for starting the application is larger than energy supplied during an application of the film to the area after the initial area of the recording paper.

The apparatus supplies a larger amount of energy than usual to the thermal head during the initial stage of the application of the top coat layer or during the application of the film to the initial area of the recording paper for the formation of the top coat layer. The thermal head promptly reaches the temperature appropriate for the top coat transfer. Accordingly, the apparatus perfectly transfers the top coat layer evenly on the initial area of the recording paper.

This invention also concerns a thermal transfer recording apparatus for thermally transferring a film of a transparent resin as a top coat layer to an image formed surface of a recording paper, which comprises a thermal head which generates heat in proportion to a supplied energy, a conveying device which relatively conveys the recording paper to the thermal head, and a control unit which keeps the supplied energy under control such that the energy supplied to the thermal head during an application of the film to an initial area of the recording paper extending along an edge in a direction perpendicular to a conveying direction, greater than an energy supplied during an application of the film to the area after the initial area of the recording paper.

The apparatus supplies the energy greater than usual to the thermal head during the application of the top coat layer to the vicinities of the edges of the recording paper. The thermal head satisfactorily transmits the heat to the film even when a gap is present at the edge of the recording paper. Thus, the apparatus faultlessly transfers the top coat layer evenly on the vicinities of the opposite sides of the recording paper.

This invention further concerns a thermal transfer recording apparatus for thermally transferring a film as a coating layer to a surface of a recording paper with a half-cut thickness line with respect to the recording paper surface, which comprises a thermal head with a plurality of heating elements being linearly arranged, which generates heat in proportion to a supplied energy, a conveying device which relatively conveys the recording paper to the thermal head, and a control unit which keeps the supplied energy under control such that the energy supplied to the thermal head during an application of the film to an area of the recording paper around the half-cut line is greater than energy supplied during an application of the film to the area after the initial area of the recording paper.

The apparatus supplies the energy greater than usual to the thermal head during the application of the top coat layer around the half-cut line of the recording paper. Thereby, the apparatus keeps the thermal head at a temperature appropriate for the top coat transfer during the printing in the neighborhood of the half-cut line. Thus, the apparatus faultlessly transfers the top coat layer even on the image area near the half-cut line.

The objects, features, and characteristics of this invention other than those set forth above will become apparent from the description given herein below with reference to preferred embodiments illustrated in the accompanying drawings.

DETAILED DESCRIPTION OF INVENTION

The embodiments of this invention will be described below with reference to the accompanying drawings.

First Embodiment

Figure 1:
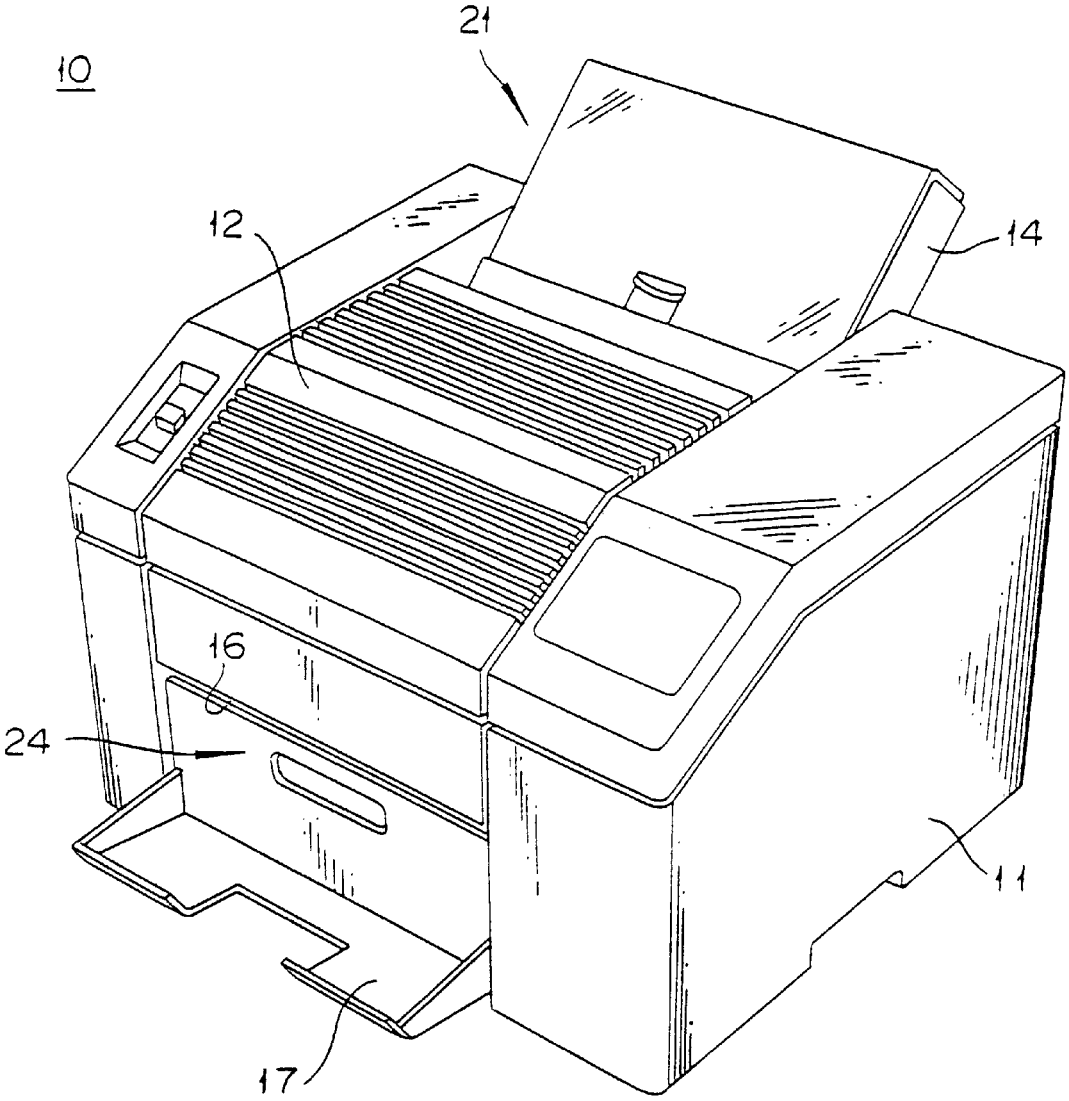
FIG. 1 is a perspective view of a thermal transfer recording apparatus according to the first embodiment of this invention.
Figure 2:
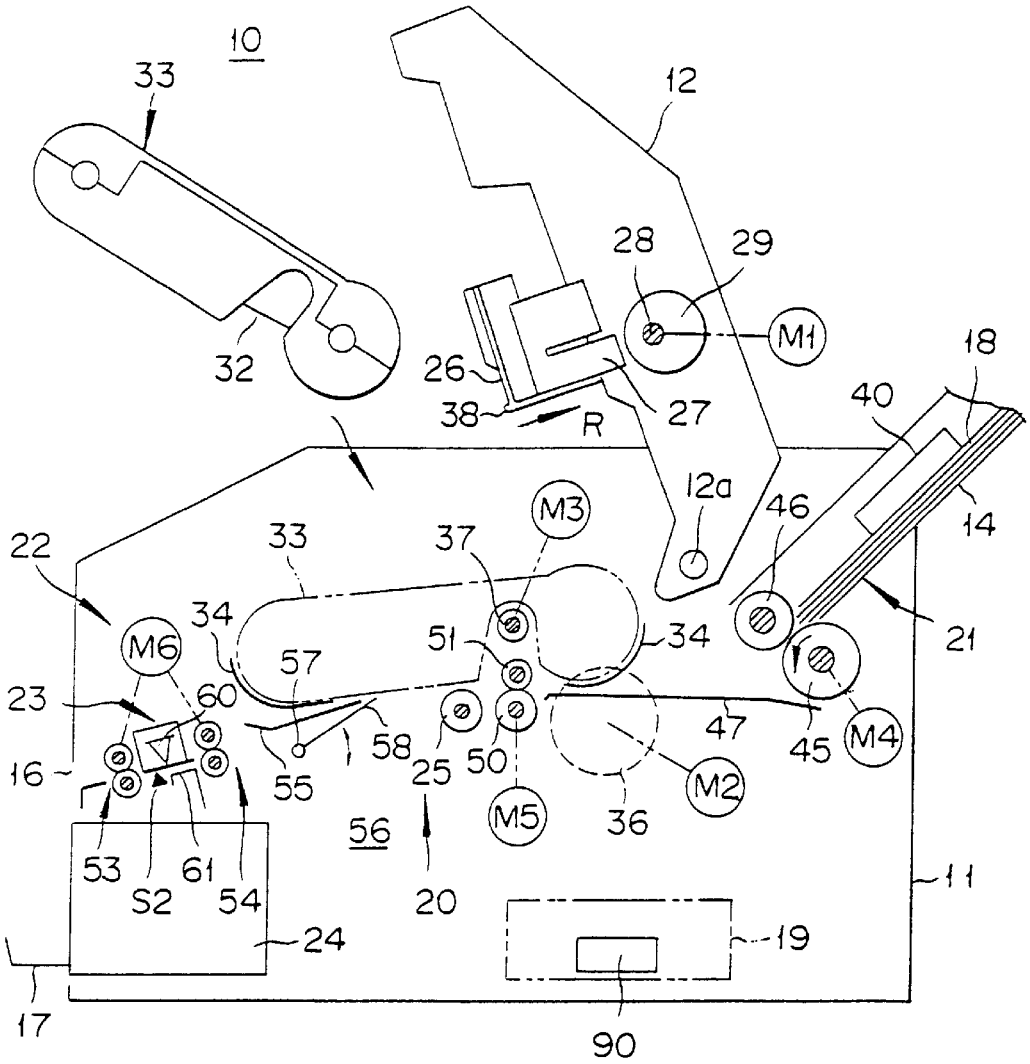
FIG. 2 is a cross section illustrating schematically the apparatus in a state keeping a lid open.
Figure 3:
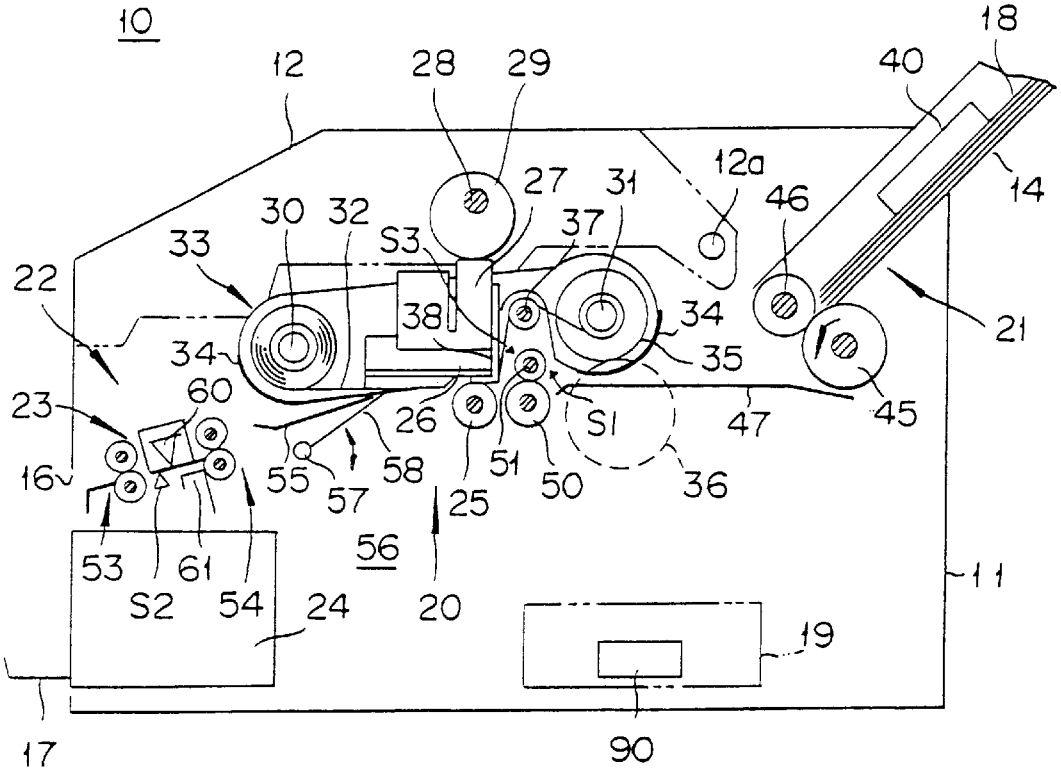
FIG. 3 is a cross section illustrating schematically the apparatus in a state having a cassette mounted in the main body.
Figure 4A:
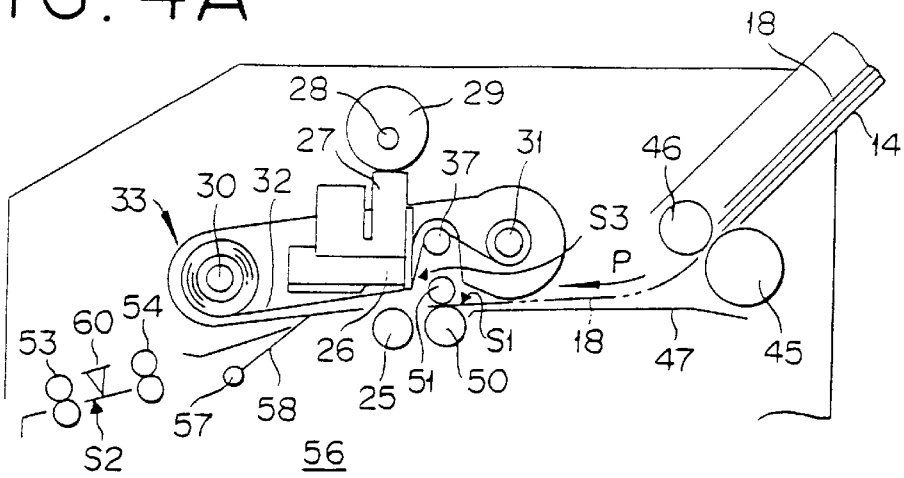
FIG. 4A is a cross section illustrating the apparatus in a state during the supply of a recording paper.
Figure 4B:
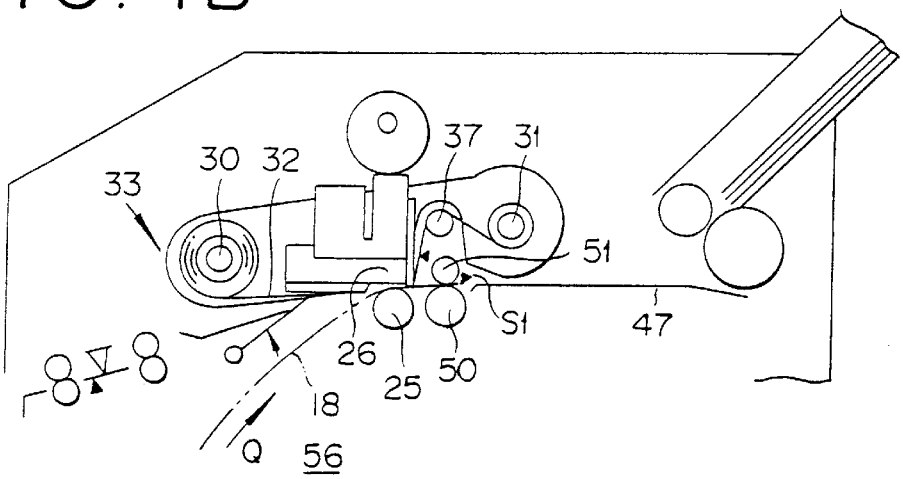
FIG. 4B is a cross section illustrating the apparatus in a state during the start of printing.
Figure 4C:
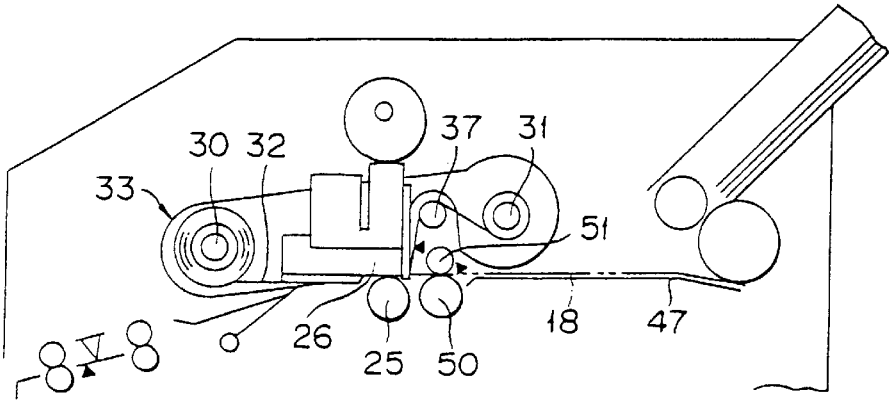
FIG. 4C is a cross section illustrating the apparatus in a state during the termination of printing.
Figure 5A:
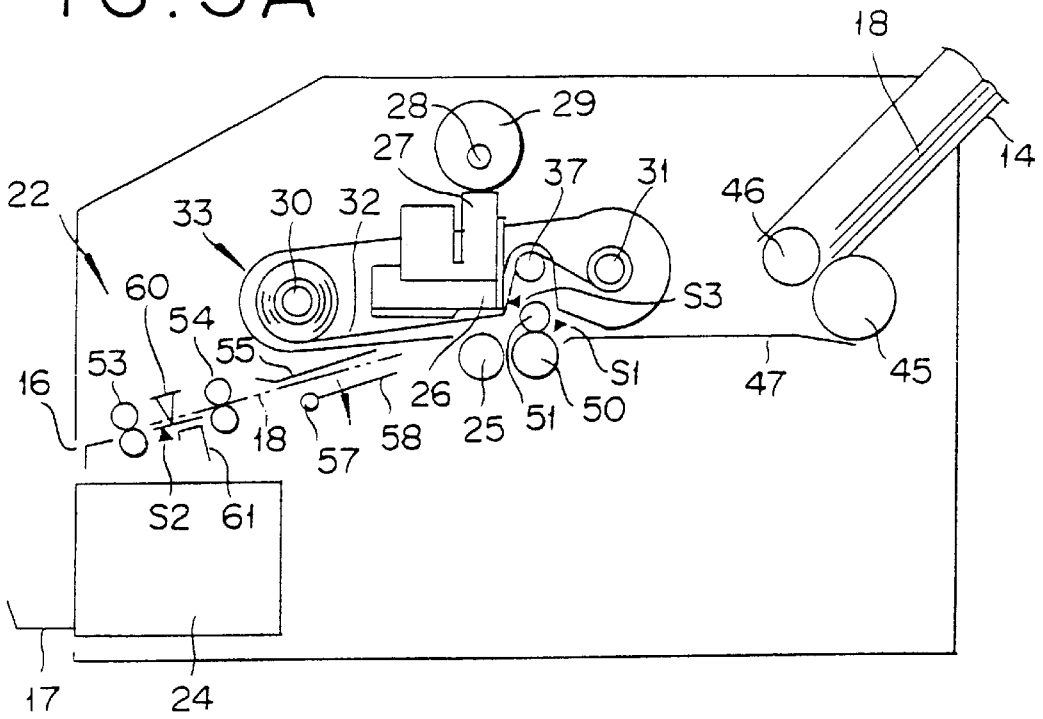
FIG. 5A is a cross section illustrating the apparatus in state during the cut of the leading end of recording paper.
Figure 5B:
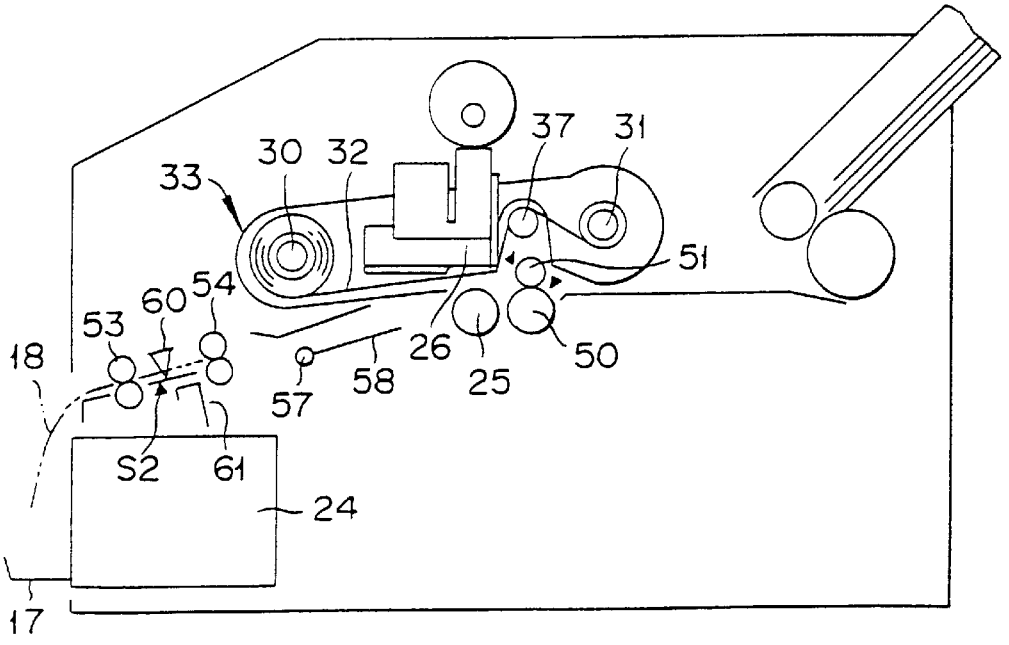
FIG. 5B is a cross section illustrating the apparatus in state during the cut of the trailing end of a recording paper.

FIG. 1 is a perspective view of the appearance of a thermal transfer recording apparatus according to this invention, FIG. 2 a cross section illustrating schematically the thermal transfer recording apparatus in a state keeping a lid open, FIG. 3 a cross section illustrating schematically the thermal transfer recording apparatus in a state having an cassette mounted in the main body, FIG. 4A–FIG. 4C cross sections illustrating schematically the states of operation of the thermal transfer recording apparatus respectively during the supply of a paper, during the start of printing, and during the termination of printing, and FIGS. 5A, 5B cross sections illustrating schematically the states of operation of the thermal transfer recording apparatus respectively during the cut of the leading end of a recording paper and during the cut of the trailing end of a recording paper. For the sake of the convenience of description, the edge of a recording paper which falls on the leading end side during the output of the recording paper will be referred to as "the leading end of the recording paper.

A thermal transfer recording apparatus 10 illustrated in the diagram is used, for example, at a processing laboratory, which prints out photographs, for a so-called index print, which reproduces the information recorded in a plurality of frames of a negative film on single recording paper. A control device (not shown) for processing the information recorded on the negative film is connected to the thermal transfer recording apparatus 10 through an interface. The control device inputs image data and control signals into the apparatus 10 through the interface.

A lid 12 is mounted on the upper face of a housing 11, which constitutes the main body of the thermal transfer recording apparatus 10, so as to be freely opened and closed around an rocking shaft 12*a* as the center. A cassette is mounted in position inside the housing 11 in a state keeping the lid open. The front of the apparatus 10 falls on the left-hand forepart side in FIG. 1. The apparatus 10 is provided with an output section 22 on the front side and a feeder section 21 on the rear side. A paper tray 14 holding a plurality of recording papers is obliquely disposed in the feeder section 21. A cutter unit 23, which cuts the unnecessary parts of the recording paper (the leading end and/or the trailing end of the recording paper) after the reproduction of an image, is disposed inside the thermal transfer recording apparatus 10. Further, a dust holder 24 for storing the cut-off portions of paper or scraps is disposed on the front side of the apparatus as to be freely inserted into and extracted from the apparatus. After the removal of the unnecessary parts, the recording paper is passed through an outlet 16 and outputted in the longitudinal direction onto a output tray 17 which is integrally formed on the front side of the dust holder 24.

The thermal transfer recording apparatus 10 of the present embodiment uses a film coated with an ink with sublimating properties. The recording paper as a medium for receiving the subliming ink has strong nerve and is relatively thick (150–250 $\mu$m) like photographic printing paper.

Now, the internal construction of the thermal transfer recording apparatus 10 will be described more specifically. A platen roller 25 is rotatably supported inside the housing 11 as illustrated in FIG. 2. A head base 27 with a thermal head 26 as a heating element is so mounted through an interlock mechanism (not shown) on the inner side of the lid 12 as to be freely moved toward and away from the platen roller 25. The thermal head 26 is moved to a position at which it makes a pressure contact with the platen roller 25 as the head base 27 is advanced toward the platen roller 25. In contrast, the thermal head 26 is moved to the position at which it breaks the pressure contact as the head base 27 is moved away from the platen roller 25. By such a pressing device as a spring (not shown), the head base 27 is urged in the direction indicated by an arrow R in FIG. 2 such that the thermal head 26 is retained at a retreated position with respect to the platen roller 25, namely at the position at which the pressure contact is broken.

An eccentric cam 29, which comes in contact to and advances the head base 27 and brings the thermal head 26 into pressure contact with the platen roller 25, is fixed to a drive shaft 28 attached rotatably to the lid 12. A drive motor Ml as a pulse motor for driving the thermal head is connected to the drive shaft 28 so as to rotate the drive shaft 28 and consequently the eccentric cam 29.

Figure 7:
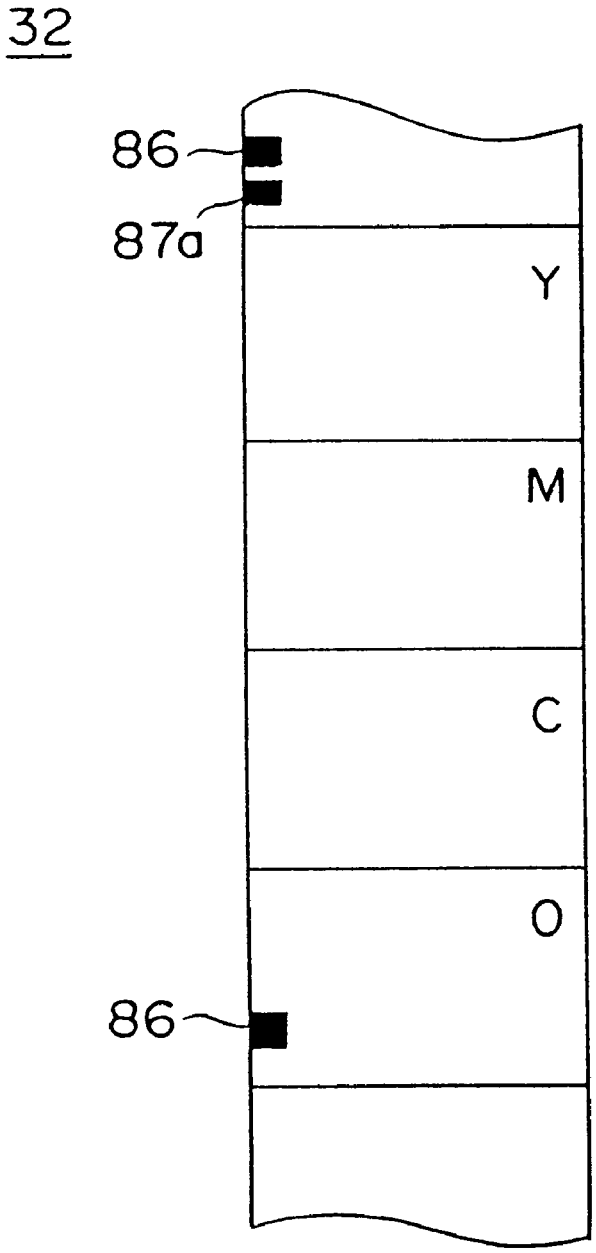
FIG. 7 is a plan view illustrating an ink film used in the apparatus of the present embodiment

An ink film 32 in the shape of a ribbon, which is unwound from a supply reel 30 and wound on a take-up reel 31, is conveyed between the thermal head 26 and the platen roller 25 as illustrated in FIG. 3. The ink film 32 is formed by applying a yellow ink layer, a magenta ink layer, a cyan ink layer, and a top coat layer sequentially in the order to a base film (FIG. 7). The two reels 30 and 31, respectively on the supply side and the take-up side, are disposed inside a cassette 33 which is freely attached to and detached from the housing 11. And the cassette 33 is set on a retaining plate 34, which is attached to the interior of the housing 11, and laid in position. A gear 35 is fitted to the take-up reel 31. The gear 35 partly confronts an opening formed in the cassette 33. A drive gear 36 provided in the apparatus is engaged with the gear 35 when the cassette is set in place. A motor M2 rotates the drive gear 36 and winds the incoming ink film 32 take-up reel 31.

A winding roller 37 is installed near the platen roller 25 so as to form a conveying path for the ink film 32 while the cassette is being mounted. This winding roller 37 is normally free to rotate, but is driven by means of a winding motor M3 through a linked clutch (not shown) exclusively when the ink film 32 requires to be moved during no printing operation. While the printing is in process, the ink film 32 is taken up in consequence of the conveyance of a recording paper 18, guided by an guide plate 38 disposed at the leading end of the thermal head 26 and an winding roller 37 presently in a free rotation state, and ultimately wound on the take-up reel 31.

The recording paper 18 is inclined on the paper tray 14. The paper tray 14 is provided with a width regulating plate 40 for the purpose of regulating the width direction of the recording paper 18. This width regulating plate 40 freely slides in the direction of width, depending on the size of the recording paper 18.

The recording papers 18 on the paper tray 14 are fed out one by one by a feeding roller 45 and a riffling roller 46 opposed to the feeding roller 45 across a minute gap, and then conveyed as guided by a guide 47. The feeding roller 45 is rotatably driven by a pulse feeding motor M4. The riffling roller 46 is fixed and not rotated. The riffling roller 46 has a hardness of 70 degrees and a coated surface. The size of the gap is set at about 0.3 mm, or a total of the paper thickness plus a certain amount. Owing to this construction, the recording paper 18 of a relatively large thickness can be smoothly fed and the surface of the recording paper 18 is not scratched. A grip roller 50 and a pinch roller 51 in pressure contact with the grip roller 50 are disposed on the upstream side and adjacently to the platen roller 25. The recording paper 18 is conveyed between the two rollers 50, 51. The pulse drive motor M5 drives the grip roller 50 to rotate, while pinch roller 51 is rotated by following the conveyance of the recording paper. The first paired discharge rollers 53 positioned on the side of the outlet 16 and the second paired discharge rollers 54 positioned on the side of the platen roller 25 side, are opposed to each other across a fixed distance on the downstream side of the platen roller 50 so as to discharge the recording paper 18 onto the output tray 17. A pulse conveying motor M6 drives these paired discharge rollers 53, 54 to rotate.

A guide 55 for guiding the conveyance of the recording paper 18 during the discharging is installed between the platen roller 25 and the paired discharge rollers 54. A space 56 is formed below the guide 55 for storing the recording paper 18 while the printing motion is produced.

For the purpose of reproducing a color image on the recording paper 18 by means of the thermal transfer recording apparatus 10, first the recording paper 18 is fed from the paper tray 14, and conveyed in the direction indicated by an arrow mark P as illustrated in FIG. 4A, and stored in the space 56 as illustrated in FIG. 4B. Then, the recording paper 18 is conveyed in the direction indicated by an arrow mark Q while a yellow image is formed on the surface. This is called the return printing system. After the recording paper 18 has been conveyed backward and the yellow image has been transferred on the surface, the recording paper 18 is conveyed forward in preparation for the subsequent reproduction of a magenta image. A color image is formed on the recording paper 18 by the sequential overlay system, or transferring, for example, monochromatic images in three colors as overlapped. The pressure contact of the thermal head 26 with the platen roller 25 is attained exclusively during the return conveyance. The thermal head 26 is separated from the platen roller 25 during the forward conveyance of the recording paper 18. The grip roller 50 and the pinch roller 51 jointly nip the recording paper 18 continuously when the backward conveyance and the forward conveyance are repeated during the printing operation.

A rocking guide 58 is so disposed below the guide 55 as to freely swing about the supporting shaft 57 as the center. The rocking guide 58 guides the recording paper 18, which is conveyed by the grip roller 50 and the pinch roller 51, selectively to either the output section 22 with the paired discharge rollers 53, 54 or the space 56. The rocking guide 58 is formed of a flexible material. The recording paper 18 conveyed by the grip roller 50 and others is received in the space 56 when the rocking guide 58 is swung to the upper position as illustrated in FIG. 4B. The recording paper 18 is conveyed toward the output section 22 when the rocking guide 58 is swung clockwise about the supporting shaft 57 as the center from the upper position to the lower position as illustrated in FIG. 5A.

For the purpose of improving the quality of a print, the recording paper 18 must avoid being nipped by the paired discharge rollers 53, 54 during the course of printing. In the present embodiment, the rocking guide 58 is disposed to form the space 56 at the position below the conveying path which is extended to the output section 22. It results in shortening the distance between the platen roller 25 and the paired discharging rollers 53, 54 and reducing the floor area for the apparatus 10.

The cutter unit 23, which is interposed between the first paired discharge rollers 53 and the second paired discharge rollers 54, is provided with a rotary cutter 60 and a pedestal 61 for cutting the recording paper 18 in cooperation with the cutter 60. The cutter unit 23 cuts the non-printed area. The scraps produced by the cutting fall under their own weight into dust holder 24 disposed at the position below the cutter unit 23.

Figure 6:
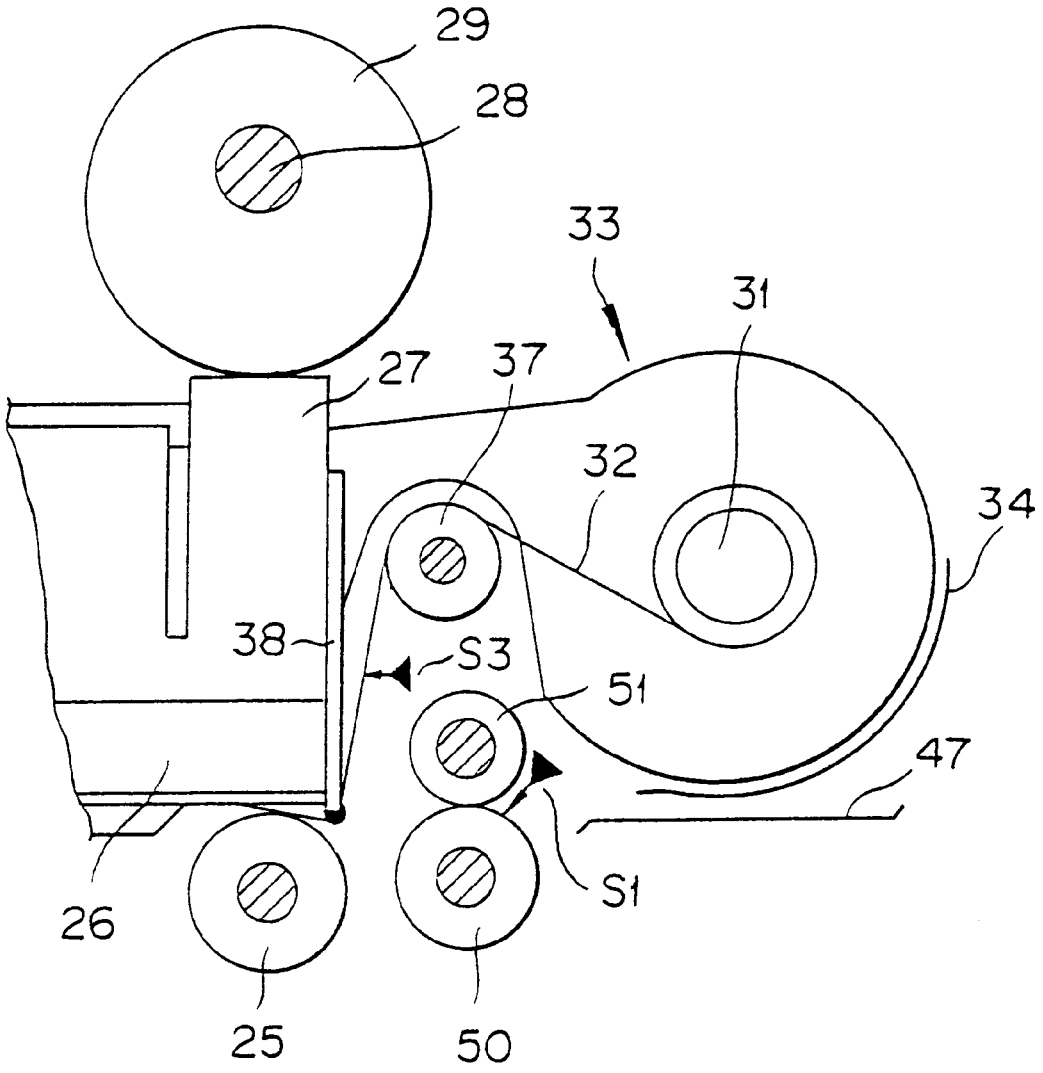
FIG. 6 is an enlarged detail of the essential part of a printer unit.

A sensor S1, which detects the leading end of the recording paper during the paper feeding or the trailing end of the recording paper during the course of printing, is installed adjacently to the grip roller 50 as illustrated in a magnified scale also in FIG. 6. The sensor S1 outputs an ON signal in case of detecting the leading end or the trailing end of the recording paper 18. The sensor S1 detects the trailing end of the recording paper during the course of printing. Thus, the sensor S1 will be referred to hereinafter as "trailing end sensor S1" for the sake of the convenience of description.

A leading end sensor S2 for detecting the leading end of the recording paper is disposed in the cutter unit 23 as illustrated in FIG. 2. The leading end sensor S2 outputs an ON signal when detecting the leading end of the recording paper 18. The pulse for driving the conveying motor M6 controls the leading end cut, which cuts the recording paper 18 in a fixed length from the leading end, and the trailing end cut, which cuts the recording paper 18 in a fixed length from the trailing end, on the basis of the time at which the leading end sensor S2 detects the leading end of the recording paper 18.

A control unit 19 is disposed in the lower section of the thermal transfer recording apparatus 10 of the present embodiment as illustrated in FIG. 2 and FIG. 3. The control unit 19 is provided with a power source for supplying an external electric power, a controller 90 as a controlling device, which receives signals via an interface from a control unit (not shown) installed outside the apparatus and controls the various units or modules in the apparatus, various circuit-boards, etc.

FIG. 7 is a plan view illustrating the ink film 32, which is used in the present apparatus. A mark sensor S3 as a detecting device, which detects a starting mark 86 formed on the ink film 32, is installed adjacently to the winding roller 37 as illustrated in FIG. 6. A reflection type photo-sensor is cited as concrete examples of the sensors S1, S2 and S3. These sensors do not need to be limited to the reflection type photo-sensors. Transmission type photo-sensors may be used instead.

The starting mark 86 is printed on the leading end (on the take-up side) of the yellow ink layer as illustrated in FIG. 7. With respect to the symbols used in the diagram, "Y" represents a yellow ink layer, "M" a magenta ink layer, "C" a cyan ink layer, and "O" a top coat layer. These layers are applied to the paper on top of one another in the order. The top coat layer, or a top coat agent as a laminating resin is thermally transferred to the whole area of the recording paper 18 coated with pigment dye, during the final stage of printing for exalting the durability of the printed area and preventing fading as already described. The top coat layer is formed of a transparent resin. Optionally, it may be modified as a colored layer by mixing the transparent resin with a transparent pigment.

The positioning of the starting point for each ink frames of the ink film 32 is accomplished by advancing the ink film 32 until the mark sensor S3 detects the starting mark 86, and then stopping the ink film 32.

The start positioning for each ink frame is executed during the forward conveyance of the recording paper 18, or between the time that the command to print is received, and the time that the trailing end sensor S1 detects the trailing end of the incoming recording paper.

Incidentally, the start positioning of a color ink layer of an ink frame is done by controlling the conveying distance of the ink film 32 in terms of pulses counted by an encoder (not shown) installed at one end of the winding roller 37.

A film end mark 87*a* is formed near the starting mark 86 only on the final ink frame of the ink film 32 as illustrated in FIG. 7. After receiving the command to print, the usual operation of the start positioning for the next ink frame is done and then printing is executed. And the mark sensor S3 is so designed as to detect the film end mark 87*a* while the printing is in process. The controller 90 discerns the final round of the printing, based on the detection of the film end mark 87*a*. Namely, the mark sensor S3 functions concurrently as an end mark sensor for detecting the film end mark 87*a*.

Figure 8:
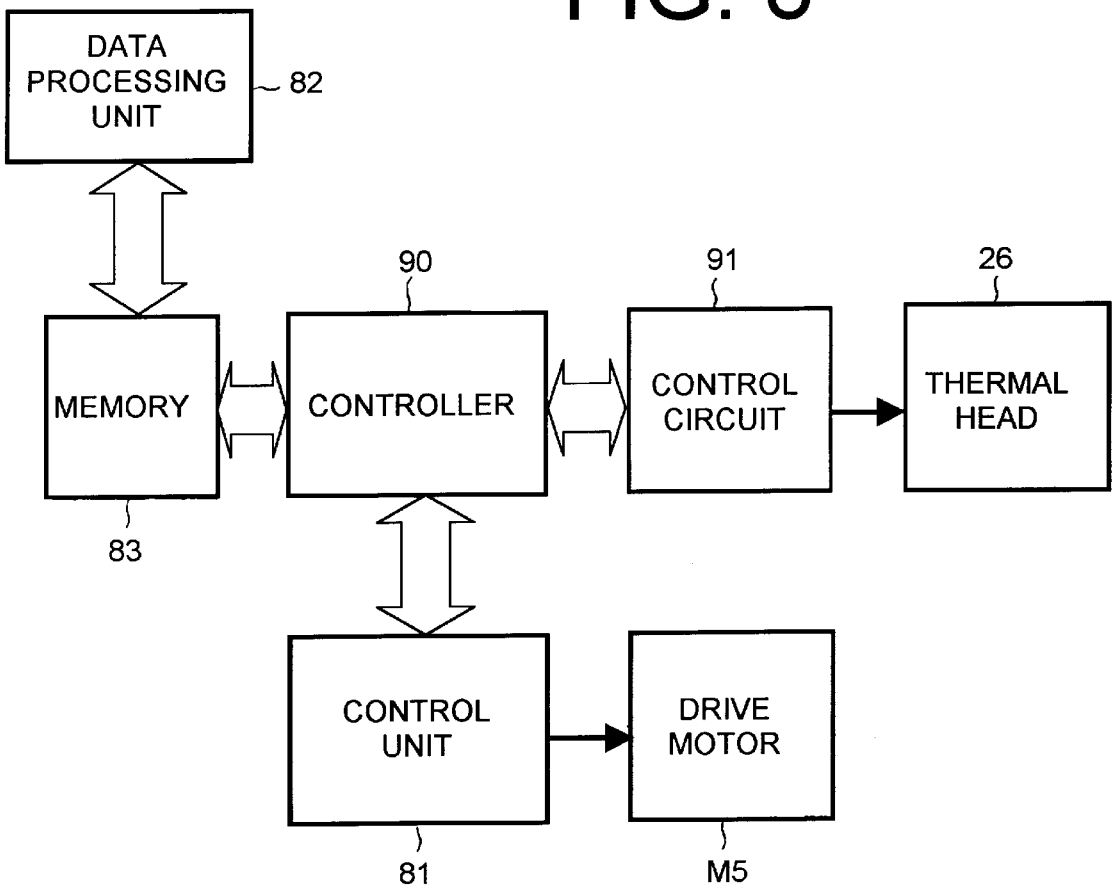
FIG. 8 is a block diagram illustrating a control system of a thermal head and a drive motor for the grip roller.

FIG. 8 is a block diagram illustrating the control system of the thermal head 26 and a drive motor M5 for the grip roller.

The thermal head 26 is connected to the controller 90 through a control circuit 91 as illustrated in the diagram. The thermal head 26 as a heating unit is provided with heating elements (not shown) which are linearly disposed in the direction perpendicular to the conveying direction of the recording paper 18. The thermal head 26 generates heat when electric power is supplied.

A memory 83 inside the apparatus temporarily stores the image data inputted by a data processing unit 82 installed outside the apparatus. The controller 90 reads the image data stored in the memory 83 and transmits a signal equivalent to the image data to the control circuit 91. The control circuit 91 applies a proper voltage to the thermal head 26. The image data (printing situation) of the top coat layer is generated by the same procedure as used for the ink layers in yellow, magenta, and cyan. Consequently, the ink layers and the top coat layer are printed on top of one another in the order.

Optionally, the data processing unit 82 may be disposed inside the apparatus, and the image data inputted by the data processing unit 82 may be directly used for printing without being stored in the memory.

A drive motor M5 for the grip roller is connected to the controller 90 through a control unit 81. The controller 90 inputs a signal to the control unit 81 to actuate the drive motor M5 so as to convey the recording paper 18 properly.

Figure 9:
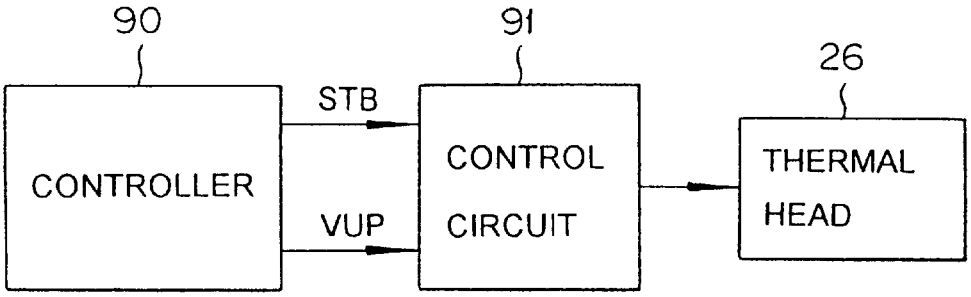
FIG. 9 is a block diagram explaining operation of the thermal head in detail.

FIG. 9 is a block diagram to assist in explaining the operation of the thermal head in detail.

As illustrated in the diagram, the controller 90 inputs a signal for applying the voltage (hereinafter referred to as "STB signal") and a signal for increasing the voltage (hereinafter referred to as "VUP signal") to the control circuit 91. The control circuit 91 applies voltage to the thermal head 26, based on these signals. Specifically, the voltage is applied through the control circuit 91 to the thermal head 26 when the STB signal is on a high level (hereinafter referred to as "H"). In contrast, no voltage is applied to the thermal head 26 when the STB signal is on a low level (hereinafter referred to as "L"). In addition, a voltage ($V_0+\Delta V$), namely the voltage having $\Delta V$ in excess of the usual voltage, $V_0$ (invariably expressed in the unit of volt) is applied to the thermal head 26 when the VUP signal is H and the STB signal is changed to be H. And the usual voltage $V_0$ is applied to the thermal head 26 when the VUP signal is L and the STB signal is changed to be H.

Figure 10:
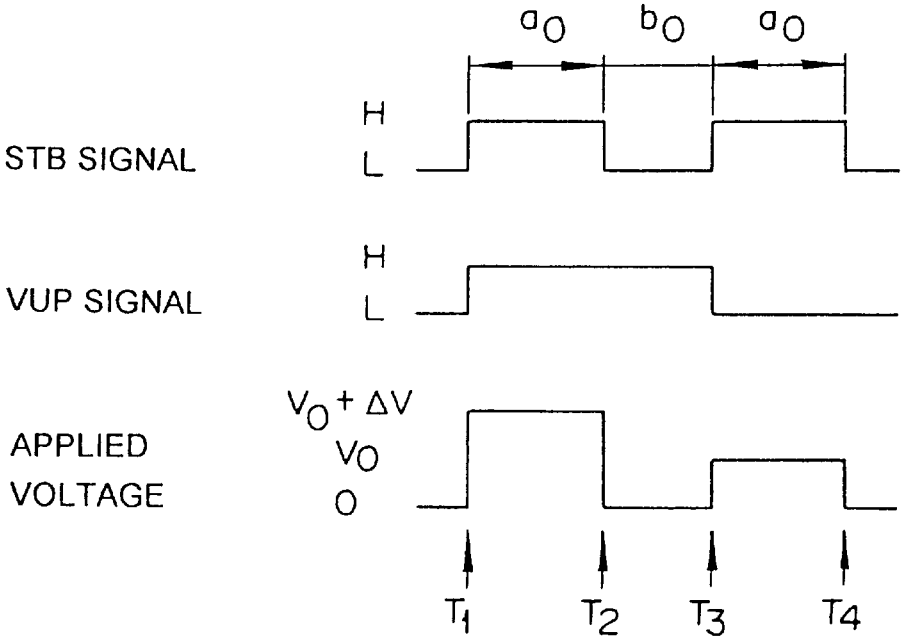
FIG. 10 is a time chart illustrating examples of a STB signal, a VUP signal and an applied voltage of the thermal head corresponding to the signals, respectively.
Figure 11:
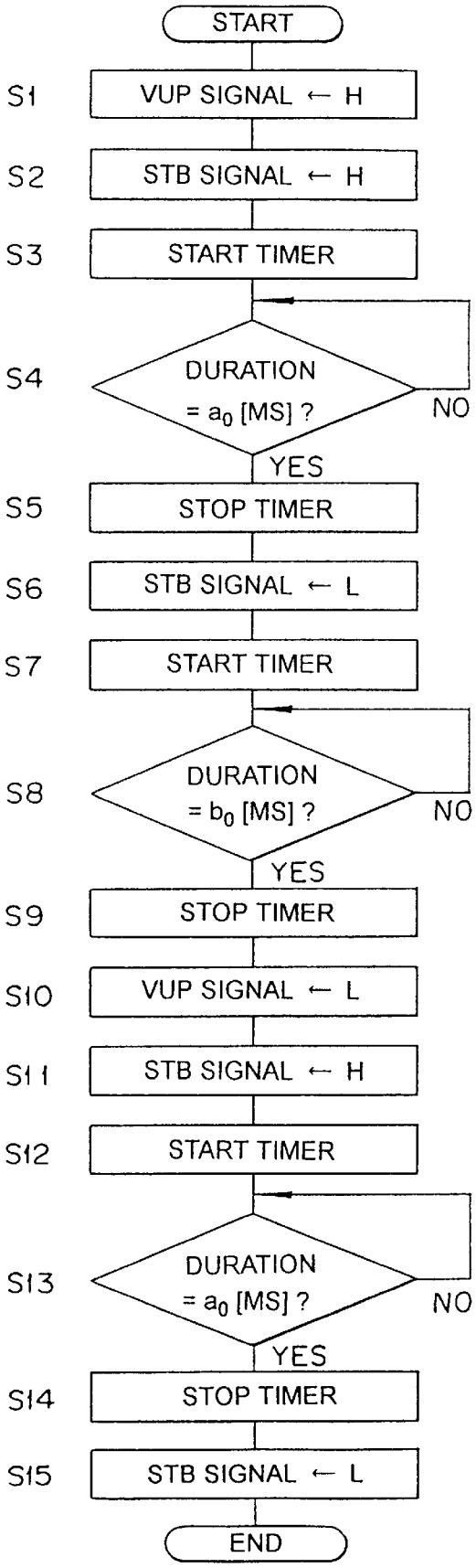
FIG. 11 is a flow chart illustrating the control system effecting the operation illustrated in FIG. 10.

FIG. 10 is a time chart illustrating examples of a STB signal, a VUP signal and an applied voltage of the thermal head corresponding to the signals, respectively, and FIG. 11 is a flow chart illustrating the control system effecting the operation illustrated in FIG. 10.

With reference to FIG. 11, the controller 90 first sets the VUP signal and the STB signal both to ($T_1$ in FIG. 10, steps S1, S2), and starts the timer (step S3). After the elapse of $a_0$ [ms] with keeping the H-state (YES at step S4), the controller 90 stops the timer (step S5) and sets the STB signal to L ($T_2$ in FIG. 10, step S6). Based on this flow, the voltage applied to the thermal head in the interval of ($T_1$–$T_2$) is set being ($V_0$+ΔV), or a higher level than usual as illustrated in FIG. 10. Then, the controller 90 starts the timer again (step S7) and, after the elapse of $b_0$ [ms] (YES at step S8), stops the timer (step S9). The controller 90 sets the VUP signal to L (step S10) and also sets the STB signal to H (step S11 in FIG. 11 and $T_3$ in FIG. 10). Based on this flow, the voltage applied to the thermal head in the interval of ($T_2$–$T_3$) is changed to be 0 [V] as illustrated in FIG. 10. Because the STB signal is L and not yet H. Further, the controller 90 starts the timer (step S12). After the elapse of $a_0$ [ms] (YES at step S13), controller 90 stops the timer (step S14) and sets the STB signal being L (step S15 in FIG. 11 and $T_4$ in FIG. 10). Based on this flow, the voltage applied to the thermal head in the interval of ($T_3$–$T_4$) is changed to be the usual level, or $V_0$ as illustrated in FIG. 10.

Figure 12:
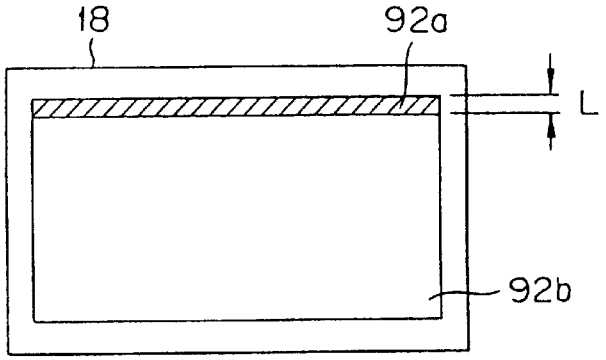
FIG. 12 is a diagram illustrating an example of printing the top coat layer.

The present embodiment particularly is designed such that the energy supplied to the thermal head 26 during the application of the top coat layer to the initial area or the initial line 92*a* is larger than the energy supplied during the application to the top coat layer to the area 92*b* after the initial area 92*a* as illustrated in FIG. 12. The thermal energy generated by the thermal head 26 is proportional to the energy supplied to the thermal head 26. The temperature of the thermal head 26 very quickly reaches the level appropriate for the top coat transfer because of applying a larger energy than usual to the thermal head 26.

The present embodiment sets the voltage applied to the thermal head 26 at a higher level than usual to increase the energy supplied to the thermal head 26 during the application of the top coat layer to the initial area.

Figure 13A:
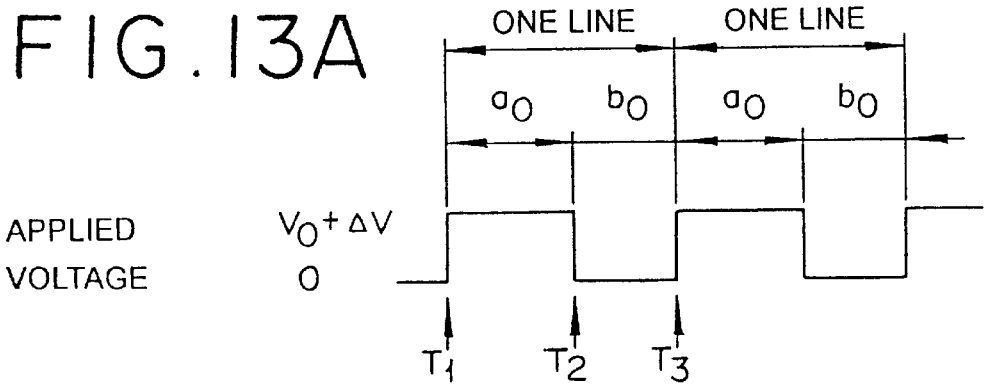
FIG. 13A is a time chart illustrating the voltage, which is applied to the thermal head in the apparatus of the first embodiment, during the application of the top coat layer to the initial area of a recording paper.
Figure 13B:
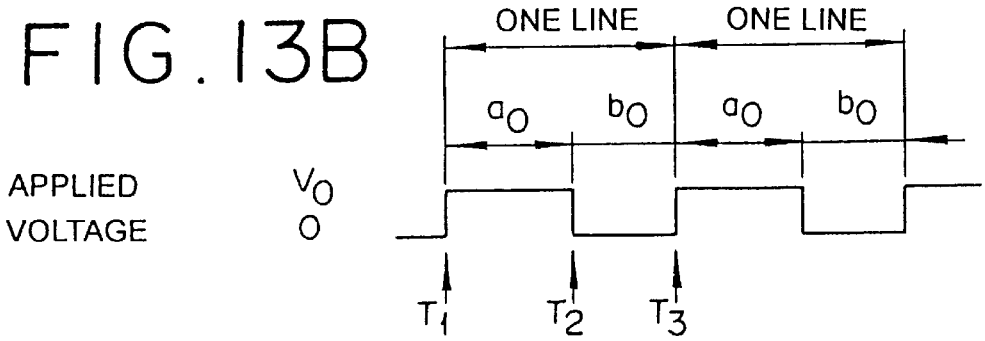
FIG. 13B is a time chart illustrating the voltage, which is applied to the thermal head in the apparatus of the first embodiment, during the application of the top coat layer to the area excepting the initial area of the recording paper.

FIG. 13A and FIG. 13B are time charts illustrating the voltage, which is applied to the thermal head; FIG. 13A represents the case for increasing the voltage applied to the thermal head to supply greater energy than usual and FIG. 13B represents the voltage applied to the thermal head to supply the usual energy. In the present embodiment, FIG. 13A is related to the voltage applied to the thermal head during the application of the top coat layer to the initial area of the recording paper and FIG. 13B is related to the voltage applied to the thermal head during the application of the top coat layer to the area after the initial area of the recording area.

As illustrated in the diagram, it is repeated every transfer coating lines that the application of voltage is continued for the period $a_0$ [ms] and then halted for the period $b_0$ [ms]. For maintaining the temperature appropriate for the thermal transfer, the energy E, which is supplied by the thermal head during the application of the top coat layer to the initial area 92*a* of the recording paper, is set so as to satisfy the following formulas, $E=E_0+\Delta E$ and $\frac{1}{2}<A\ E/E_0<1$, wherein $E_0$ represents the energy, which is supplied during the application of the top coat layer to the area other than the initial area of the recording paper. The lower limit of the range of $\Delta E/E_0$ is required for quickly heating the thermal head up to the temperature appropriate for the transfer and for ensuring infallible top coat transfer to the recording paper. The upper limit of the range of $\Delta E/E_0$ is required for preventing the thermal energy generated by the thermal head from excessively increasing to the extent of ultimately inducing fast adhesion between the film after the top coat transfer and the recording paper, and for allowing infallible separation.

The supplied energy E is expressed by the formula, $E=(V^2\times R)\times t$, wherein V stands for the voltage applied to the thermal head, R for the resistance of the thermal element of the thermal head, and t for the time of the application of the voltage. Thus, the formula, $\frac{1}{2}\leqq\Delta E/E_0\leqq 1$, may be modified to the formula, $(3/2)\times E_0\leqq E_0+\Delta E\leqq 2\times E_0$, when the supplied energy E is controlled, based on the applied voltage V. Further, the formula may be modified to the formula, $(3/2)\times V_0^2\leqq(V_0+\Delta V)^2$, and $(3/2)^{1/2}\times V_0\leqq(V_0+\Delta V)\leqq 2^{1/2}\times V_0$.

The voltage V, which is applied to the thermal head 26 during the application of the top coat layer to initial area 92*a*, is set so as to fulfill the relationships, $V=V_0+\Delta V$ and $V_0\times(-1+(3/2)^{1/2})\leqq\Delta V\leqq V_0\times(-1+2^{1/2})$, wherein $V_0$ stands for the voltage, which is applied to the thermal head 26 during the application of the top coat layer to the area 92*b* other than the initial area.

The initial area 92*a*, in which a greater energy than usual is supplied by the thermal head 26, requires that the length $L_1$ from a position for starting the application is within 2 mm and a temperature detected by a thermistor thermometer (not shown) fitted to the thermal head 26 is not more than 40° C. Because the temperature of the thermal head 26 will fall to a level no longer appropriate for the top coat transfer, and the temperature perfect for the top coat transfer will possibly fail to last if the distance from the foremost position is less than 2 mm in spite of the application of greater energy. Namely, if a temperature detected by the thermistor thermometer surpasses 40° C., the thermal energy generated by the thermal head 26 will excessively increase possibly to the extent of inducing the ink film after the top coat transfer, to adhere so fast to the recording paper that they may not be easily separated. If a temperature is lower than 40° C., the top coat transfer will be satisfactorily done even when the applied voltage is subsequently changed to be the usual level.

Now, the operation of the thermal transfer recording apparatus will be described below on the basis of the main flow of the printing operation of the top coat layer illustrated in FIG. 14, referring to FIG. 4A–FIG. 4C, FIG. 5*a* and FIG. 5B.

<<Paper feeding (FIG. 4A)>>

When the controller 90 outputs a command to print, the feeding motor M4 sets the feeding roller 45 rotating to advance just one recording paper 18 in the direction of the arrow mark P. The feeding motor M4 is stopped when the trailing end sensor S1 detects the leading end of the recording paper 18. Then, the drive motor M5 sets the grip roller 50 rotating to convey the recording paper 18 further forward. The drive motor M5 is stopped when the trailing end sensor S1 detects the trailing end of the recording paper 18. The forward conveyance of the recording paper 18 is effected while the thermal head 26 is kept apart from the platen roller 25. The rocking guide 58 is swung to the upper position and the recording paper 18 is guided to the space 56.

Simultaneously with the paper feeding, the ink film is positioned for the start of thermal transfer. This start positioning of the film is effected by forwarding the ink film 32 toward the take-up side until the mark sensor S3 detects the leading end mark 86, and stopping the ink film 32. The winding motor M3 drives the winding roller 37 to rotate after coupling with a clutch (not shown).

<<Start of printing (FIG. 4B)>>

The printing is ready for starting when the positioning of the ink film is completed. Specifically, the thermal head 26 is pressed against the platen roller 25. The grip roller 50 is rotated to convey the recording paper 18 backward in the direction of the arrow mark Q. Then, the printing is started immediately after the trailing end sensor S1 has detected the trailing end of the recording paper and a yellow image is formed on the recording paper 18. The conveying system which conveys the recording paper backward during the course of printing is limited to the grip roller 50.

Incidentally, this printing operation is immediately preceded by the judgment whether or not the mark sensor S3 has detected a film end mark 87*a*.

<<Completion of printing (FIG. 4C)>>

When the printing of the yellow image is completed, the return conveyance of the recording paper 18 is stopped and the pressure contact of the thermal head 26 with the platen roller 25 is released.

When printing the next color or printing a top coat is executed, the grip roller 50 conveys forward and guides the recording paper to the space 56 for storage as illustrated in FIG. 4B. The forward conveyance to the starting position for printing is effected by rotating the grip roller drive motor M5 with proper pulses. In concert with this preparation for the printing in the next color, the winding motor M3 is rotated and the positioning of the next ink layer is performed as the encoder provided at one end of the winding roller 37 counts the number of pulses corresponding to the conveying distance of the ink film 32. The printing in the next color is performed by carrying out the same printing operation.

After this operation has been repeated on all the colors, a top coat layer is thermally transferred to the entire surface of the recording paper 18, having already received the pigment dyes, during the final stage of printing. Namely, a top coat layer is applied to the recording paper 18.

Now, the operation for the application of the top coat layer will be described in detail below.

Figure 14:
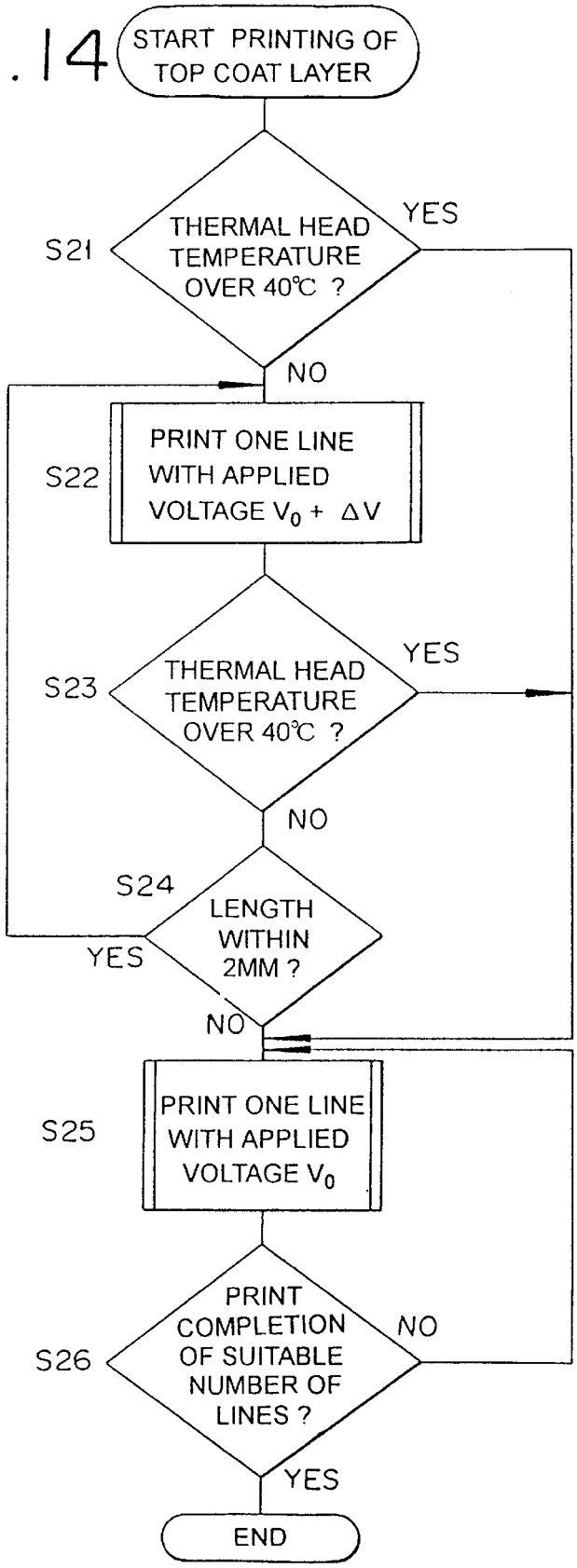
FIG. 14 is a main flow of the operation of printing the top coat layer.

With reference to FIG. 14, first it is judged whether or not a temperature measured by the thermistor thermometer fitted to the thermal head exceeds 40° C. (step S21). When the judgment is negative, the process flow is advanced to the next step S22.

At this step S22, one line of the top coat layer is transferred with a larger voltage than usual. Specifically, one line of the top coat layer in the initial area 92*a* is transferred with the voltage $V=(V_0+\Delta V)$, or the voltage being $\Delta V$ larger than the voltage $V_0$, which is applied to the thermal head 26 during the application to the area 92*b* other than the initial area 92*a*.

Figure 15:
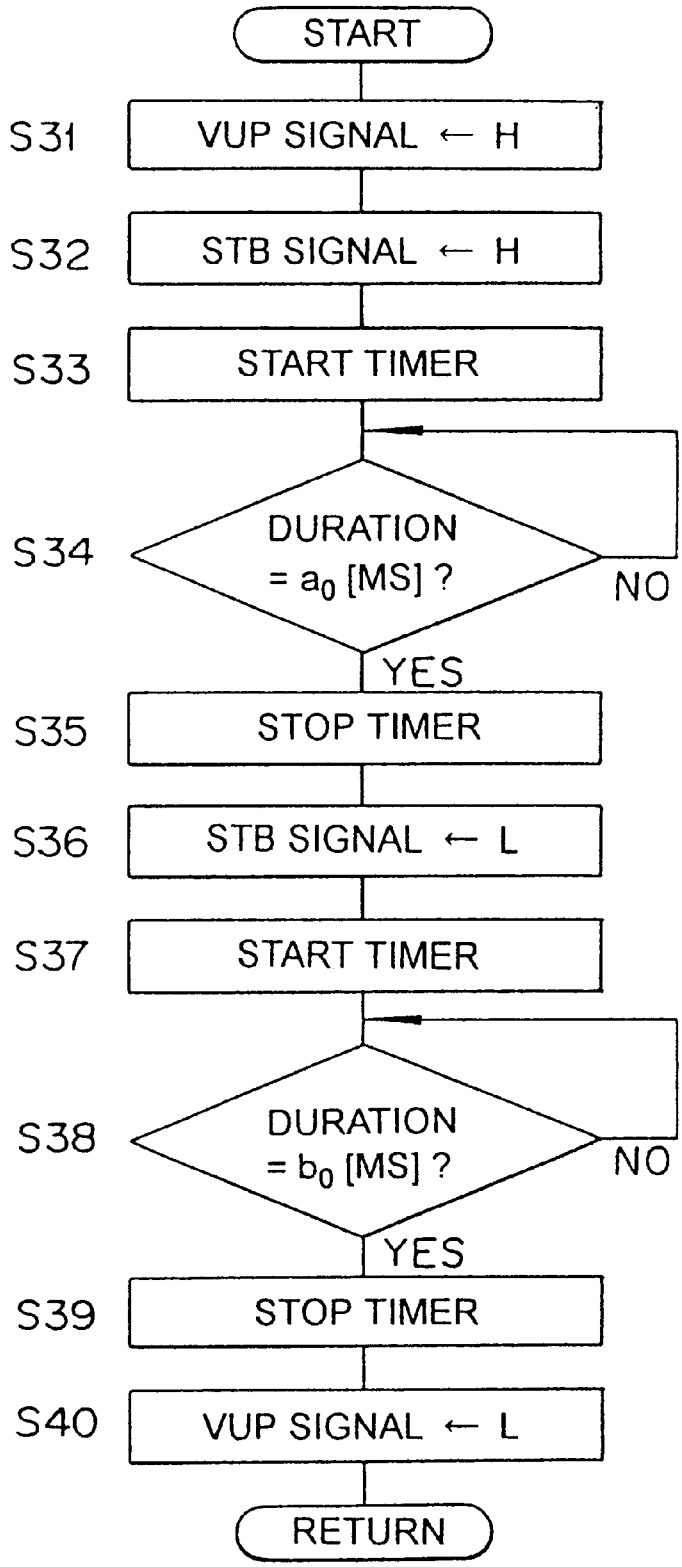
FIG. 15 is a subroutine of the operation of printing one line of the top coat layer shown in FIG. 14 with the applied voltage $V=(V_0+\Delta V)$.

FIG. 15 is a subroutine of the operation of printing one line of the top coat layer with the applied voltage ($V=V_0+\Delta V$), or a subroutine of step S22 as shown in FIG. 14. To be specific, first the VUP signal and the STB signal are set to H ($T_1$ in FIG. 13A, steps S31 and S32) and the timer is started (step S33) After the elapse of $a_0$ [ms] with keeping the H-state (YES at step S34), the timer is stopped (step S35). Then, the STB signal is set to L ($T_2$ in FIG. 13A, step S36) as illustrated in FIG. 15. Based on the condition, the voltage applied to the thermal head in the interval ($T_1-T_2$), is set to a higher level ($V_0+\Delta V$) than usual as illustrated in FIG. 13A. Subsequently, the timer is started again (step S37). After the elapse of $b_0$ [ms] (YES at step S38), the timer is stopped (step S39). Then, the VUP signal is set to L (step S40, $T_3$ in FIG. 13A) and the control flow is returned to the main flow. Based on the condition, the voltage applied to the thermal head in the interval ($T_2-T_3$) is changed to be 0 [V]. Because the STB signal continues to be L as illustrated in FIG. 13A.

The process for printing or thermally transferring one line with the voltage $V=(V_0+\Delta V)$ is executed repeatedly (steps S22–S24) so long as a temperature detected by the thermistor thermometer fitted to the thermal head does not surpass 40° C. (NO at step S23) and the distance from the initial position in the direction of application is about 2 mm (YES at step S24).

By applying a larger energy than usual to the thermal head 26 during the application of the top coat layer to the initial area 92*a*, the top coat transfer is attained perfectly. Because the thermal head 26 quickly reaches a temperature appropriate for the top coat transfer with a small number of lines from the foremost position.

The process flow advances to the step S25 when a temperature detected by the thermistor thermometer is judged to exceed 40° C. at the step S21 or S23, or when the length from the foremost position exceeds 2 mm.

At this step S25, the one line of the top coat layer is transferred with the usual voltage. To be specific, the transfer is effected with the voltage $V_0$, which is applied to the thermal head 26 during the application to the usual area 92*b* other than the initial area.

Figure 16:
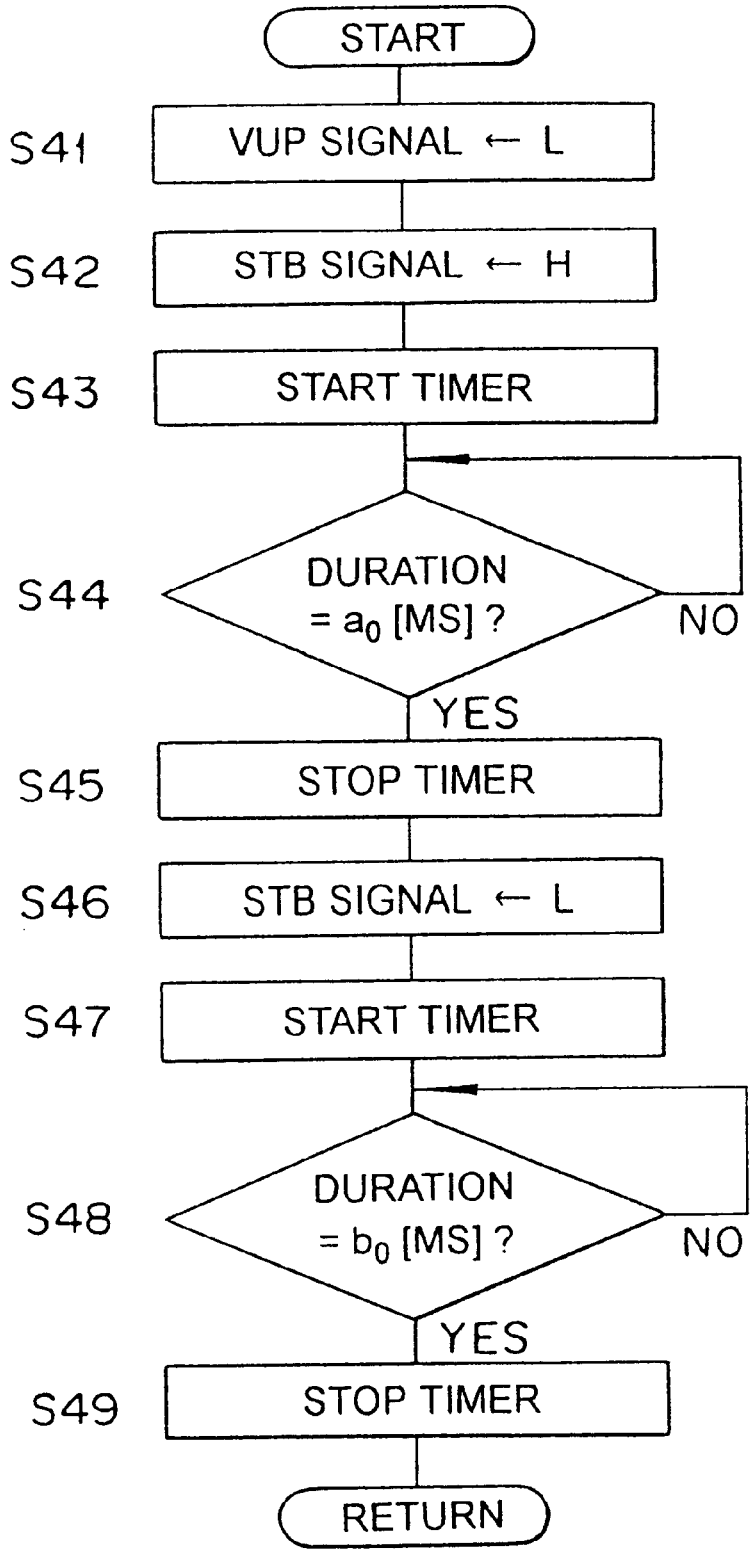
FIG. 16 is a subroutine of the operation of printing one line of the top coat layer shown in FIG. 14 with the applied voltage $V_0$.

FIG. 16 is a subroutine of the operation of printing one line with the voltage $V_0$, or a subroutine of step S25 as illustrated in FIG. 14. To be specific, as illustrated in FIG. 16, first the VUP signal is set being L and the STB signal is set being H ($T_1$ in FIG. 13B, steps S41, S42) and the timer is started (step S43). After the elapse of $a_0$ [ms] with keeping the state (YES at step S44), the timer is stopped (step S45). Then, the STB signal is set being L ($T_2$ in FIG. 13B, step S46). Based on the condition, the voltage applied to the thermal head in the interval ($T_1-T_2$)is changed to be the usual voltage $V_0$ as illustrated in FIG. 13B. Then, the timer is started again (step S47). After the elapse of $b_0$ [ms] (YES at step S48), the timer is stopped ($T_3$ in FIG. 13B, step S49) and the process flow is returned to the main flow. Based on the condition, the voltage applied to the thermal head in the interval ($T_2-T_3$) is changed to be 0 [V]. Because the STB signal continued to be L as illustrated in FIG. 13B.

The operation of printing one line with the applied voltage $V_0$ or step S25 is done repeatedly. When the printing of the suitable number of lines is completed (YES at step s25), the printing of the top coat layer is completed.

Incidentally, when the mark sensor S3 detects the film end mark 87*a* (not shown), the operation of winding the ink film is executed subsequently to the completion of the printing of the top coat. Then, the message indicating the film end is outputted to the display of the recording apparatus. When the mark sensor S3 does not detect the film end mark 87*a*, the winding of the ink film 32 being forwarded in concert with the printing operation is stopped in preparation for the next round of the printing.

<<Leading end cut (FIG. 5A)>>

The pressure contact of the thermal head 25 with the platen roller 25 is released, and the rocking guide 58 is swung to the lower position when the printing of one frame is completed. The grip roller 50 forward conveys and guides the recording paper 18 toward the output section 22. The conveying motor M6 is also rotated at a suitable timing, and the second paired discharging rollers 54 convey the recording paper 18. Then, the cutter unit 23 cuts the suitable length of the recording paper from the leading end while the pulses of the conveying motor M6 are controlled, based on the time at which the leading end sensor S2 detects the leading end of the recording paper 18. The cut-off or the dust drops into the dust holder 24 for collection.

In this while, the conveyance of the recording paper 18 is halted temporarily.

<<Training end cut (FIG. 5B)>>

When the leading end cut is completed, the conveying motor M6 is driven by such a number of pulses as corresponds to the suitable conveying length, and the first and the second paired discharging rollers 53, 54 convey the recording paper 18. The cutter unit 23 cuts the suitable length of the recording paper 18 from the trailing end. The cut-off or the dust drops into the dust holder 24 for collection. Accordingly, a user obtains a so-called border-less image without the non-print area because of the cut-off. After the collection of the scraps of paper resulting from the cutting is completed, the first paired discharging rollers 53 convey and output the recording paper 18 onto the output tray 17.

The thermal transfer recording apparatus 10 of the present embodiment is designed such that the energy supplied to the thermal head 26 during the application of the top coat layer to the initial printing area 92*a* is larger than the energy supplied during the application of the top coat layer to the printing area 92*b* after the initial area 92*a*. Thus, the thermal head 26 is quickly heated up to the temperature appropriate for the top coat transfer, and the top coat transfer to the initial area is improved.

Further, the energy E, which is applied to the thermal head 26 during the application of the top coat layer to the initial area 92*a*, is so set as to satisfy the following formulas, $E=E_0+\Delta E$ and $\frac{1}{2} \leqq \Delta E/E_0 \leqq 1$, wherein $E_0$ represents the energy, which is supplied to the thermal head during the application of the top coat layer to the area 92*b* after the initial area 92*a*. It results in preventing the possibility that the thermal energy generated by the thermal head 26 will become unduly large and the film after the top coat transfer will adhere fast to the recording paper, and heating the thermal head up to a temperature appropriate for the top coat transfer with an extremely small number of lines from the foremost position for printing or transferring.

Moreover, the energy supplied to the thermal head 26 is larger than usual during the application of the top coat layer to the area extending to a length, which is about 2 mm, from the starting position for printing or transferring. It results in avoiding the possibility that a temperature of the thermal head 26 will fall and a temperature appropriate for the top coat transfer will no longer be retained In addition, the voltage applied to the thermal head is set being the usual level when a temperature detected by the thermistor thermometer fitted to the thermal head is not lower than 40° C. This results in keeping a temperature appropriate for the transfer, and precluding the possibility that the film after the top coat transfer will adhere fast to the recording paper.

Second Embodiment

Figure 17:
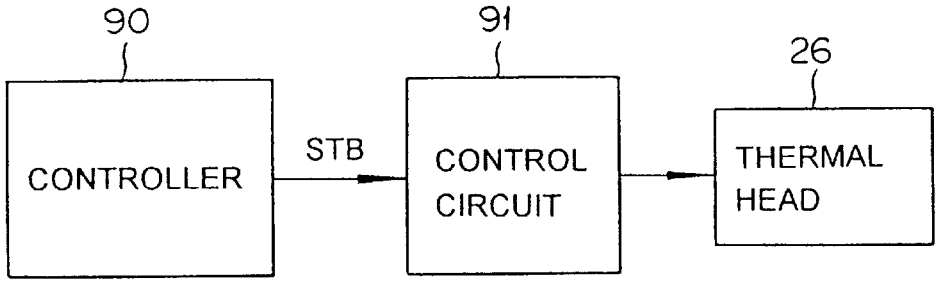
FIG. 17 is a block diagram explaining the operation of a thermal head of a thermal transfer recording apparatus according to a second embodiment.

FIG. 17 is a block diagram of assistance in minutely explaining the operation of a thermal head of a thermal transfer recording apparatus according to the second embodiment.

In the second embodiment, the energy, which is supplied to the thermal head 26 during the application of the top coatlayer to the initial area, is larger than the energy which is applied during the application of the top coat layer to the area other than the initial area, similarly in the first embodiment. It is different from the first embodiment with respect to the following two points. One is that the thermal head 26 is connected to the controller 90 through the control circuit 91 as illustrated in the diagram. The other is that the time of the application of the voltage per line of the top coat layer is set being longer than usual for the purpose of increasing the energy supplied to the thermal head 26 with respect to the application of the top coat layer to the initial area.

The controller 90 exclusively transmits the STB signal to the control circuit 91. Based on this signal, the control circuit 91 applies the voltage to the thermal head 26. To be specific, the choice between applying and not applying the usual voltage $V_0$ to the thermal head 26 depends on the setting of the STB signal, H or L.

Figure 18A:
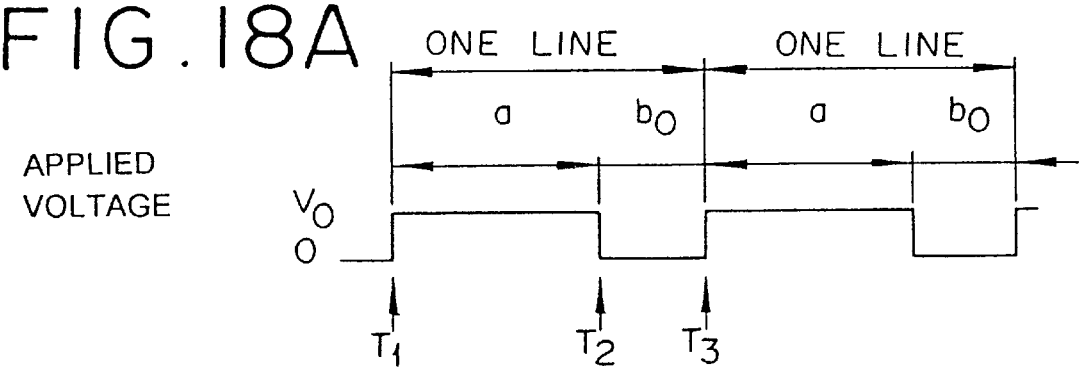
FIG. 18A is a time chart illustrating the voltage, which is applied to a thermal head of the apparatus of the second embodiment, during the application of the top coat layer to the initial area of a recording paper.
Figure 18B:
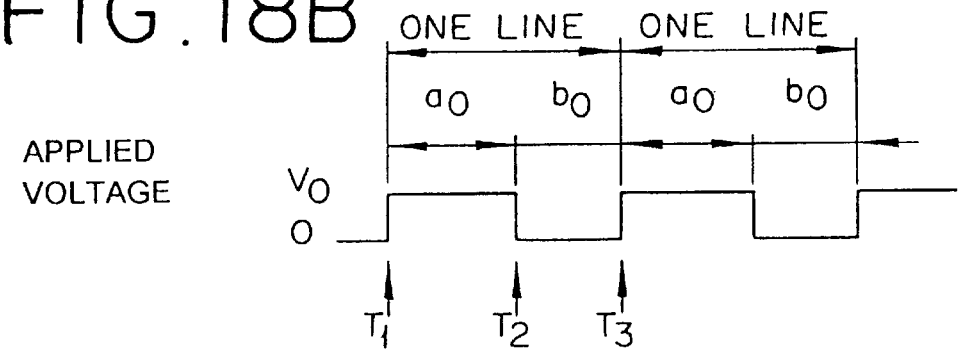
FIG. 18B is a time chart illustrating the voltage, which is applied to the thermal head of the apparatus of the second embodiment, during the application of the top coat layer to the area excepting the initial area of the recording area.

FIG. 18A and FIG. 18B are time charts showing the voltage applied to the thermal head of the apparatus according to the second embodiment; FIG. 18A representing the case of lengthening the application duration of the voltage to the thermal head for supplying a larger energy than usual and FIG. 18B showing the voltage, which is applied to the thermal head for supplying the usual energy, and the application duration of the voltage. In the present embodiment, FIG. 18A depicts the voltage, which is applied to the thermal head with respect to the initial area of the top coat layer, and the application duration of the voltage and FIG. 18B depicts the voltage, which is applied to the thermal head with respect to the area after the initial area of the top coat layer, and the application duration of the voltage.

Figure 19:
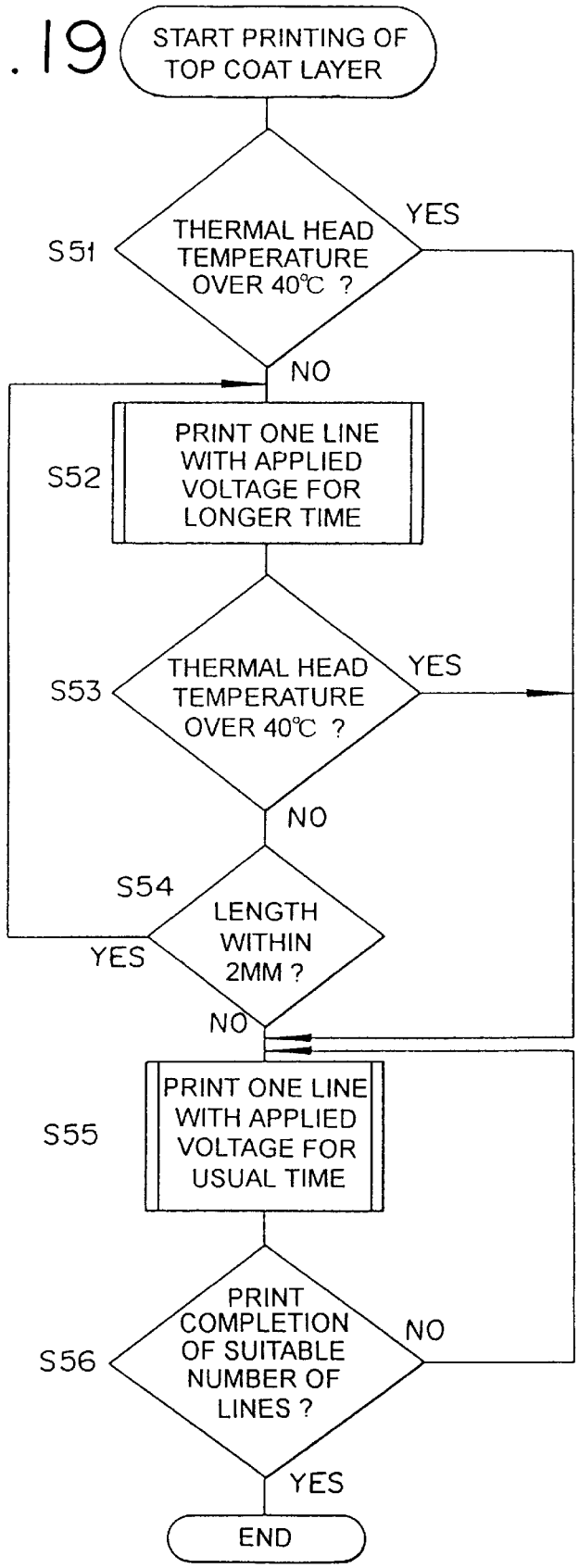
FIG. 19 is a main flow of the operation of printing the top coat layer in the apparatus according to the second embodiment.
Figure 20:
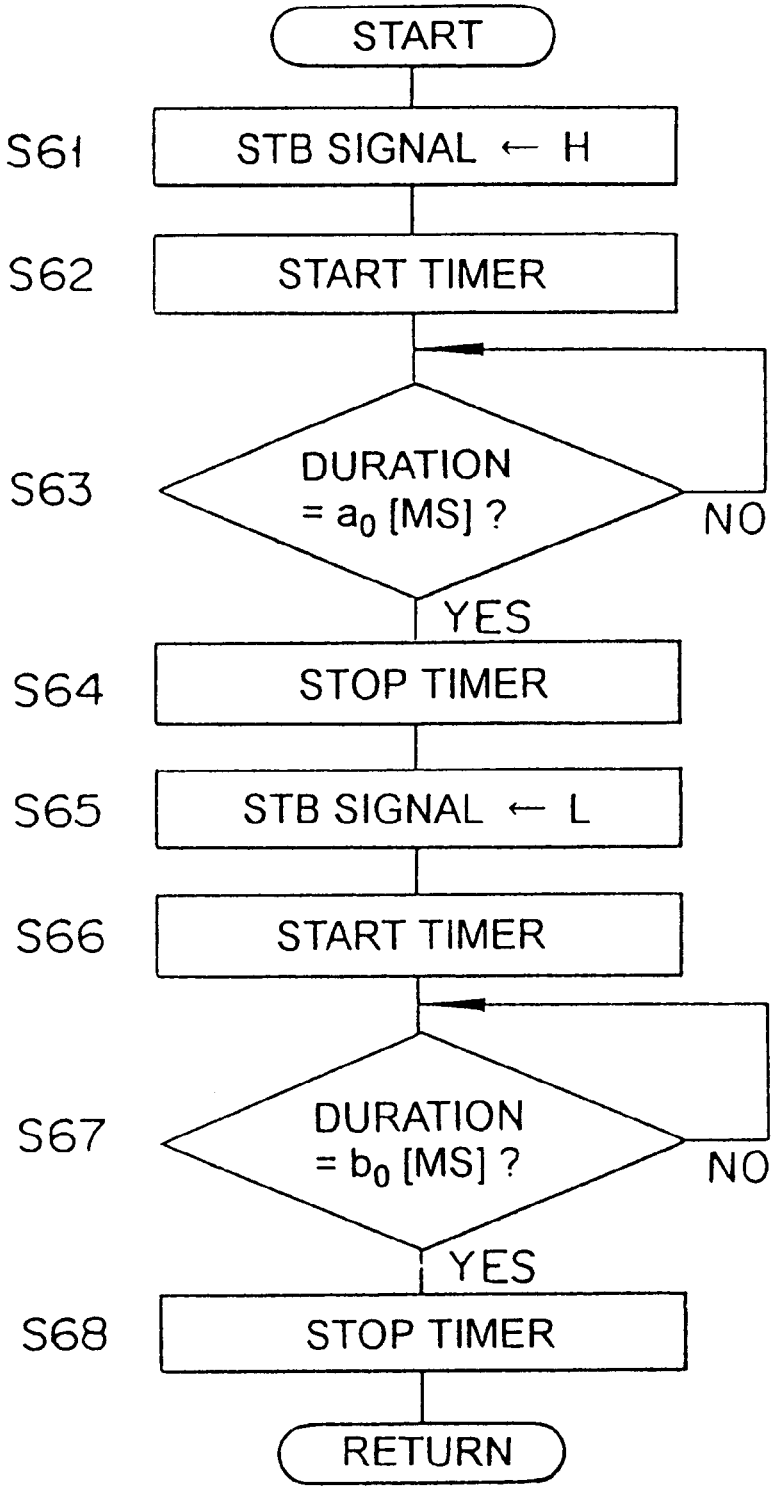
FIG. 20 is a subroutine of the operation of printing one line of the top coat layer shown in FIG. 19 under application of a voltage for a longer time than usual.
Figure 21:
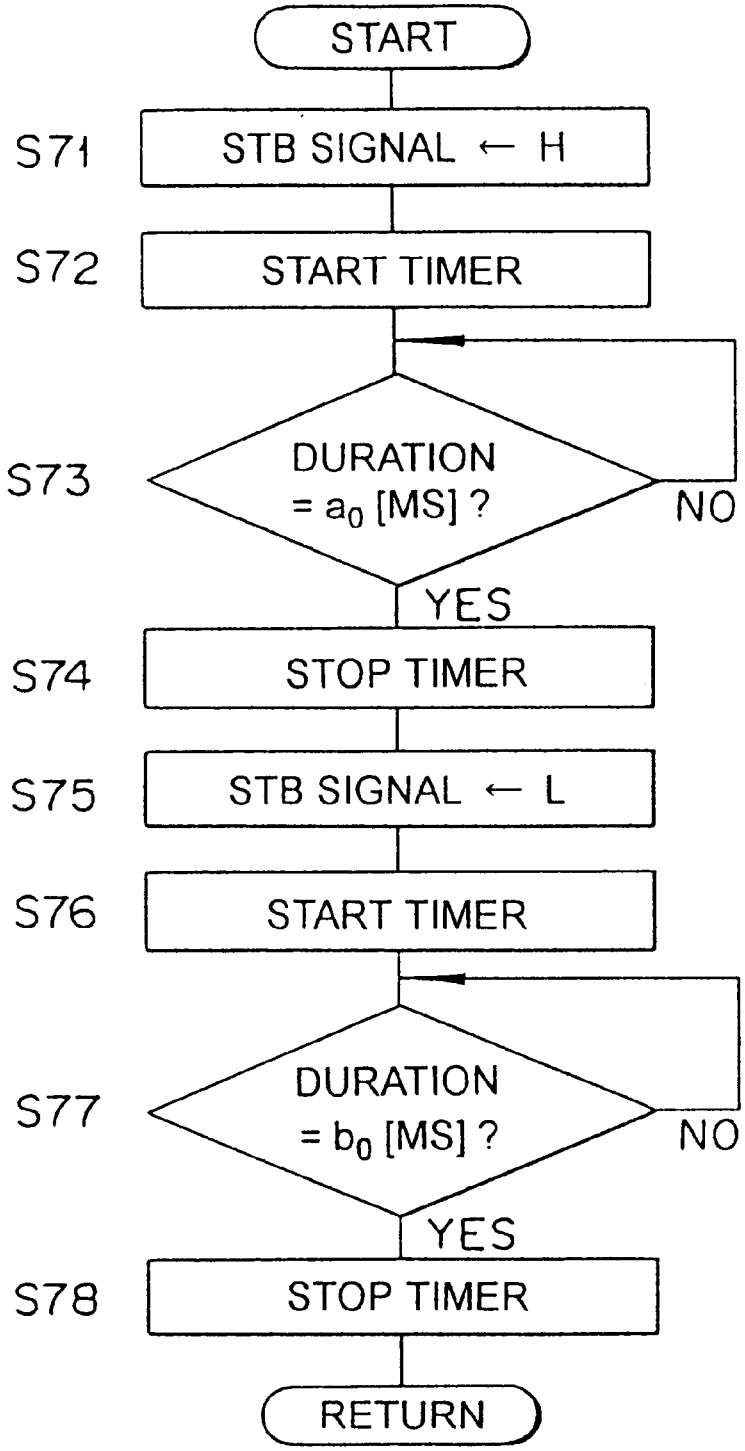
FIG. 21 is a subroutine of the operation of printing one line of the top coat layer shown in FIG. 19 under application of a voltage for a normal length of time.

FIG. 19 is a main flow of the operation of printing the top coat layer in the apparatus according to the second embodiment, FIG. 20 is a subroutine of the operation of printing one line of the top coat layer shown in FIG. 19 under application of a voltage for a longer time than usual, and FIG. 21 is a subroutine of the operation of printing one line of the top coat layer shown in FIG. 19 under application of a voltage for a normal length of time.

Next, the operation of printing the top coat layer in the second embodiment will be described below with reference to FIG. 19–FIG. 21.

With reference to FIG. 19, it is judged whether or not a temperature detected by the thermistor thermometer fitted to the thermal head is higher than 40° C. (step S51). The process flow advances to the next step S52 when the judgment is negative. At this step S52, the transfer of one line of the top coat layer is effected by the application of voltage over a longer duration than usual. Specifically, the other area 92*b* except for the initial area 92*a* is subjected to the processing (FIG. 18B) that the voltage is applied for the duration $a_0$ [ms] for one line of the top coat layer and the application of this voltage is halted for the duration $b_0$ [ms]. The initial area 92*a* is subjected to the processing (FIG. 18A) that the voltage is applied for the duration a [ms] for one line of the top coat layer and the application of this voltage is halted for the duration $b_0$ [ms].

The embodiment controls the supplied energy E, based on the duration t of the application of the voltage. The application duration a of voltage to the thermal head 26 with respect to the initial area 92*a* is so set, in connection with the relation, $E=(V^2/R)\times t$, as to satisfy the formulas, $a=a_0+\Delta t$ and $a_0/2 \leqq \Delta t \leqq a_0$, wherein $a_0$ stands for the application duration of voltage to the thermal head 26 with respect to the area 92*b* after the initial area 92*a*. The usual voltage, $V_0$, is applied to the thermal head 26.

To be specific, first the STB signal is set being H ($T_1$ in FIG. 18A, step S61) and the timer is started (step S62) as illustrated in FIG. 20. After the elapse of a [ms] with keeping the H state (YES at step S63), the timer is stopped (step S64) and the STB signal is set to L ($T_2$ in FIG. 18A, step S65). Namely, the application duration of the voltage to the thermal head in the interval ($T_1$–$T_2$ )is longer ($a_0+\Delta t$) than usual as illustrated in FIG. 18A. Subsequently, the timer is started again (step S66). After the elapse of $b_0$ [ms] (YES at step S67), the timer is stopped ($T_3$ in FIG. 18A, step S68) and the process is returned to the main flow. As a result, the voltage applied to the thermal head in the interval ($T_2$–$T_3$ )is changed to be 0 [V] because the STB signal continues to be L. And the duration of this suspension is set to the usual duration $b_0$ as illustrated in FIG. 18A.

The process of printing or transferring the one line of the top coat layer over a longer application duration of voltage than usual (with the voltage $V_0$,) is repetitively done (steps S52–S54) so long as a temperature detected by the thermistor thermometer fitted to the thermal head does not surpass 40° C. (NO at step S53) and the length of the start position of the application is within 2 mm (YES at step S53).

The process advances to the step S55 when it is judged that a temperature detected by the thermistor thermometer is over 40° C. at the step S51 or S53, or when the length of the start position of the application surpasses 2 mm.

At this step S55, the transfer of one line of the top coat layer is done with the usual application duration. In other words, the voltage is applied to the one line for the duration $a_0$ [ms] with respect to the usual area 92*b* after the initial area 91*a* , and then the application of this voltage is halted for the duration $b_0$ [ms] (FIG. 18B).

To be specific, first the STB signal is set to H ($T_1$ in FIG. 18B, step S71) and the timer is started (step S72) as illustrated in FIG. 21. After the elapse of $a_0$ [ms] with keeping H state (YES at step S73), the timer is stopped (step S74) and the STB signal is set to L ($T_2$ in FIG. 18B, step S75). As a result, the application duration of the voltage to the thermal head in the interval ($T_1$–$T_2$) is set to the usual value $a_0$ as illustrated in FIG. 18B. Subsequently, the timer is started again (step S76). After the elapse of $b_0$ [ms] (YES at step S77), the timer is stopped ($T_3$ in FIG. 18B, step S78) and the process is returned to the main flow. As a result, the voltage applied to the thermal head in the interval ($T_2$–$T_3$) is changed to be 0 [V]. Because the STB signal continues to be L. The duration of this suspension is the usual duration $b_0$ as illustrated in FIG. 18B.

It is repeated that the transfer of one line of the top coat layer is done with the usual application duration of voltage (step S55). When the transfer of the suitable number of lines of the top coat layer is completed (YES at step S56), the printing of the top coat layer is completed. This embodiment prints or thermally transfers the one line of the top coat layer over the longer application duration of voltage than usual with respect to the initial area 92*a*, and thereby supplies the greater energy than usual to the thermal head 26. In short, the embodiment also has the advantages such as the improvement of the top coat transfer to the initial area are attained similarly in the first embodiment.

Third Embodiment

Figure 22:
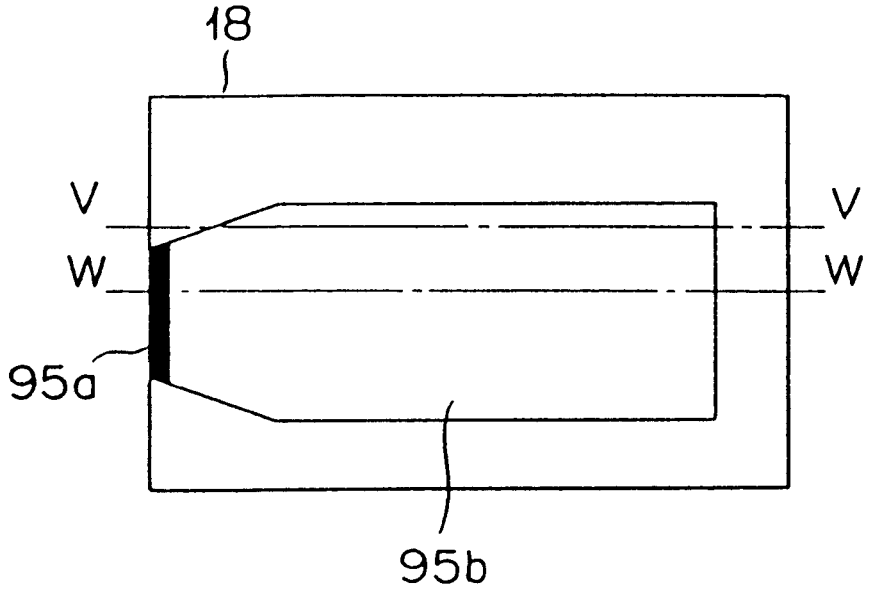
FIG. 22 is a diagram illustrating an example of printing the top coat layer by means of a thermal transfer recording apparatus according to the third embodiment.
Figure 23:
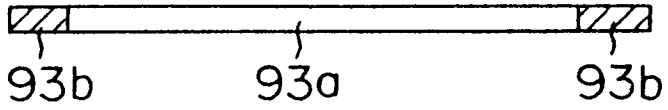
FIG. 23 is a diagram illustrating the image data of one line of the top coat layer corresponding to a section taken on line V—V of FIG. 22.
Figure 24:
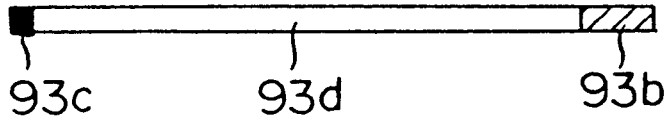
FIG. 24 is a diagram illustrating the image data of one line of the top coat layer corresponding to a section taken on line W—W of FIG. 22.

FIG. 22 is a diagram illustrating an example of printing the top coat layer by means of a thermal transfer recording apparatus according to the third embodiment, FIG. 23 is a diagram illustrating the image data of one line of the top coat layer corresponding to a section taken on line V—V of FIG. 22, and FIG. 24 is a diagram illustrating the image data of one line of the top coat layer corresponding to a section taken on line W—W of FIG. 22. In FIG. 22, the area enclosed in a hexagonal shape on the recording paper 18 is the area on which the top coat layer is printed.

The third embodiment is so designed as to keep the energy supplied to the thermal head 26 under control such that the energy during the application of the top coat layer to the area 95*a* of the recording paper extending along the edge in a direction perpendicular to a conveying direction is greater than the energy during the application of the top coat layer to the other area 95*b* of the recording paper as illustrated in FIG. 22.

The edge area 95*a* suffers from an insufficient transfer of heat, due to the presence of a gap in the lateral edge of the recording paper. Thus, the embodiment supplies greater energy than usual to the thermal head 26 during the application of the edge area 95*a*, and retains a temperature of the thermal head 26 at a level appropriate for the top coat transfer. The construction of the thermal transfer recording apparatus and the system of controlling the thermal head in this embodiment are identical with those of the first embodiment and will be omitted from the following description.

Concerning the image data of the top coat layer in FIG. 23, corresponding to the section taken on line V—V of FIG. 22, the image data of a white zone 93*a* at the center of the diagram is subjected to the application of usual energy, and the image data of hatched zones 93*b* on both side of the white zone 93*a* is not subjected to the application of usual energy.

Concerning the image data of the top coat layer in FIG. 24, corresponding to the section taken on line W—W of FIG. 22, the image data of a white zone 93*d* at the center of the diagram is subjected to the application of usual energy, the image data of the hatched zone 93*b* on the right side is not subjected to the application of usual energy, and the image data of a black zone 93*c* on the left side is subjected to the application of greater energy than usual.

The third embodiment sets the voltage applied to the thermal head 26 to a greater level than usual for the purpose of increasing the energy to be supplied to the thermal head 26 during the application of the top coat layer to the edge area 95*a* corresponding to the vicinity of the edge of the recording paper.

Figure 25A:
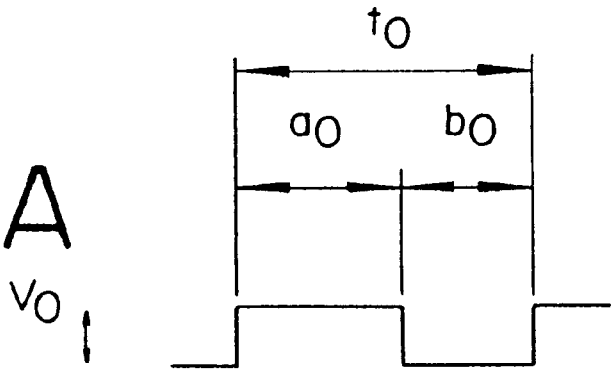
FIG. 25A is a time chart illustrating the voltage, which is applied to a heating element of a thermal head in the apparatus according to the third embodiment, corresponding to the image data of a white zone shown in FIG. 23.
Figure 25B:
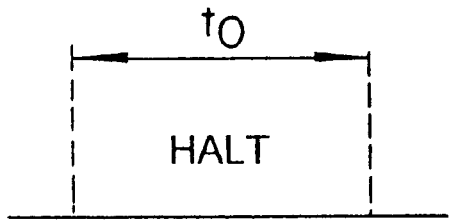
FIG. 25B is a time chart illustrating the voltage, which is applied to the thermal head in the apparatus according to the third embodiment, corresponding to the image data of a hatched zone shown in FIGS. 23 and 24.
Figure 25C:
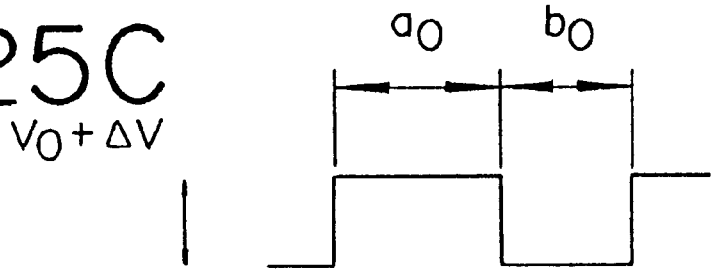
FIG. 25C is a time chart illustrating the voltage, which is applied to the thermal head in the apparatus according to the third embodiment, corresponding to the image data of a black zone shown in FIG. 24.
Figure 25D:
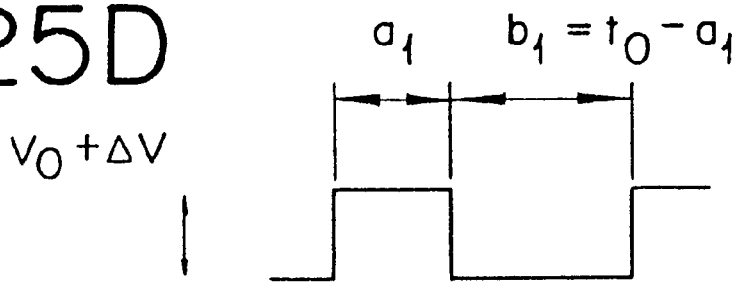
FIG. 25D is a time chart illustrating the voltage, which is applied to the thermal head in the apparatus according to the third embodiment, corresponding to the image data of the white zone shown in FIG. 24.

FIG. 25A–FIG. 25D are time charts illustrating the voltages for application to the thermal head of the apparatus according to the third embodiment; FIG. 25A represents the voltage applied to the heating element of the thermal head, corresponding to the image data of the white zone 93*a* shown in FIG. 23, FIG. 25B represents the voltage applied with respect to the image data of the hatched zone 93*b* shown in FIG. 23 and FIG. 24, FIG. 25C represents the voltage applied with respect to the image data of the black zone 93*c* shown in FIG. 24, and FIG. 25D represents the voltage applied with respect to the image data of the white zone 93*d* shown in FIG. 24.

The applied voltage and the application duration for the heating elements in each line is decided in response to the image data (printing situation) of the top coat layer. The top coat transfer is based on the data of the white zone 93*a* at the center shown in FIG. 23, it is repeated on all the lines for retaining the temperature appropriate for the transfer that the voltage $V_0$ is applied over the duration $a_0$ [ms] and the application of the voltage is halted over the duration $b_0$ [ms] as illustrated in FIG. 25A. Meanwhile, the top coat transfer based on the data of the black zone 93*c* shown in FIG. 24, is repeated for supplying greater energy than usual over the duration $a_0$ [ms] with respect to the edge area 95*a* corresponding to the vicinity of the edge of the recording paper wherein the voltage $V_0+\Delta V$ is applied over the duration $a_0$ and the application of the voltage is halted over the duration $b_0$ [ms] as illustrated in FIG. 25C.

Here, the energy E, which is applied to the thermal head with respect to the edge area 95*a* is set so as to satisfy the formulas, $E=E_0+\Delta E$ and $1/5 \leqq \Delta E/E_0 \leqq 1$, wherein $E_0$ stands for the energy, which is applied to the thermal head with respect to the usual area 95*b* other than the edge area 95*a*. The lower limit of the range for $\Delta E/E_0$ is required for infallibly transferring the top coat layer to the recording paper. And the upper limit is required for preventing the thermal energy, which is generated by the thermal head, from excessively increasing to the extent of ultimately inducing fast adhesion between the film after the top coat transfer and the recording paper, or to enable infallible separation of the film and the recording paper. The edge area 95*a* is set, corresponding to the range of 2 mm inward from the edge of the recording paper in the direction perpendicular to the conveying direction, and thereby, the top coat layer is infallibly printed with high efficiency.

Incidentally, the supplied energy E is expressed by the formula, $E=(V^2/R)\times t$, wherein V stands for the voltage applied to the thermal head, R for the resistance of the thermal element of the thermal head, and t for the time of the application of the voltage. When the supplied energy E is controlled with the applied voltage V, the formula, $1/5 \leqq \Delta E/E_0 < 1$, may be modified to the formula, $(6/5)\times E_0 \leqq E_0+\Delta E \leqq 2\times E_0$. Further, the formula may be modified to the formula, $(6/5)\times V_0^2 \leqq (V_0+\Delta V)^2 \leqq 2\times V_0^2$, and $(6/5)^{1/2}\times V_0 \leqq (V_0+\Delta V) \leqq 2^{1/2}\times V_0$.

The voltage V, which is applied to the thermal head 26 with respect to the edge area 95*a*, is so set as to satisfy the formulas, $V=V_0+\Delta V$ and $V_0\times(-1+(6/5)^{1/2}) \leqq \Delta V \leqq V_0\times(-1+2^{1/2})$, wherein $V_0$ stands for the voltage, which is applied to the thermal head 26 with respect to the usual area 95*b* other than the edge area 95*a*.

The thermal head supplies an equal usual thermal energy to the white zone 93*a* at the center shown in FIG. 23 and the white zone 93*d* at the center shown in FIG. 24, and adjust the application duration of the thermal energy in proportion to a difference of the applied voltages. Specifically as illustrated in FIG. 25D, the application duration al for the larger voltage $V=(V_0+\Delta V)$ is shorter than $a_0$ so as to satisfy the formula, $a_1=(V_0/(V_0+\Delta V))^2\times a_0$.

Figure 26:
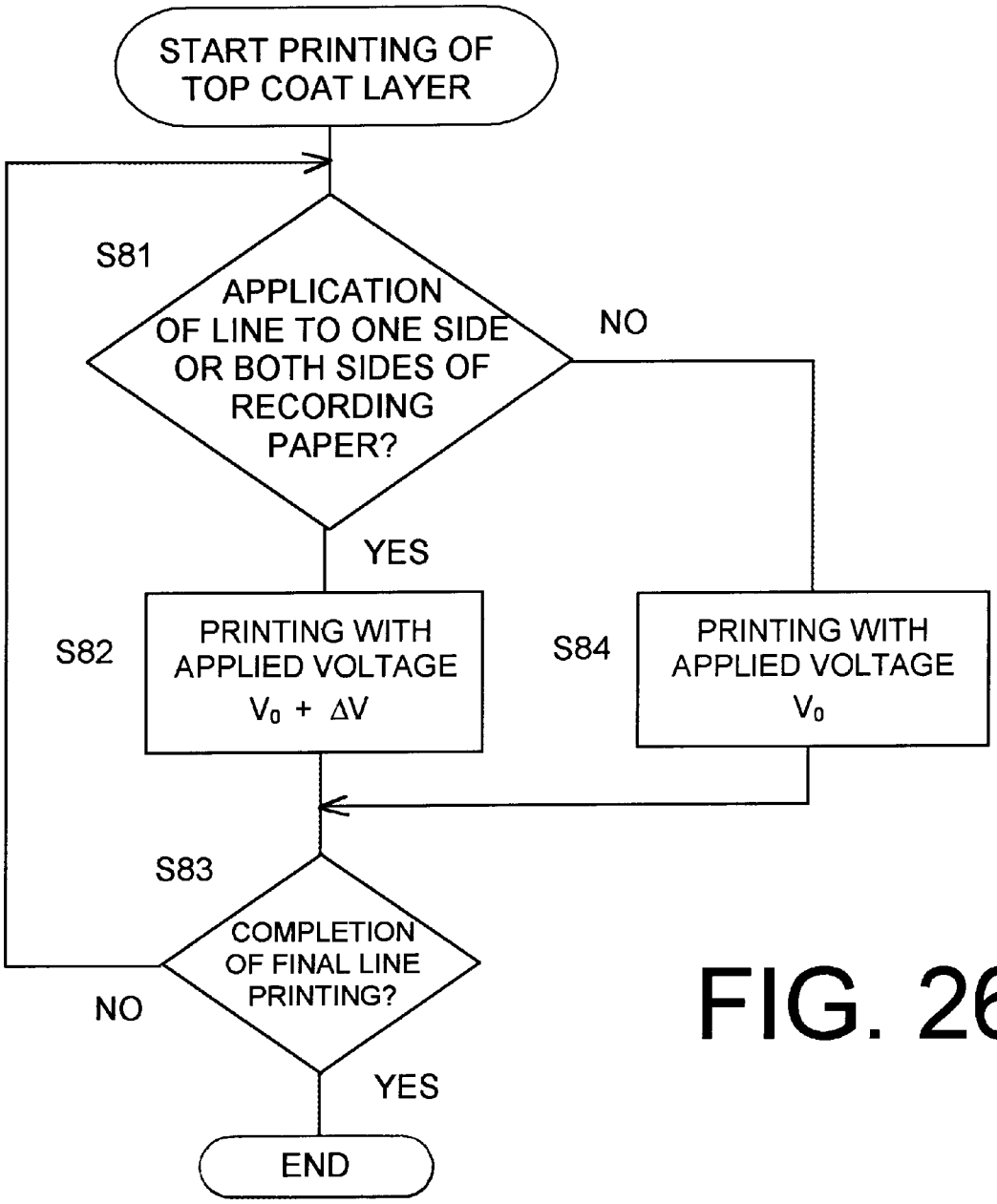
FIG. 26 is a flow chart of the operation of printing the top coat layer in the third embodiment.

FIG. 26 is a flow chart of the operation for printing the top coat layer in the third embodiment.

First, it is determined whether or not the line of the top coat layer includes an area corresponding to at least one side of the recording paper for heating or thermal transfer (step S81). Specifically, it is checked whether or not the apparatus stands in a printing situation that the line of the top coat layer is applied to the edge area 95*a* corresponding to the vicinity of the edge of the recording paper.

When the decision is YES at the step S81, namely when it is determined that the apparatus stands in the printing situation that the line of the top coat layer is applied to the edge area 95*a*, the process is advanced to the step S82, and the printing of the top coat layer is started with the voltage applied to the thermal head 26 greater than usual. Namely, the one line of the top coat layer corresponding to the edge area 95*a* is thermally transferred under the voltage $V=(V_0+\Delta V)$, which is larger by $\Delta V$ than the voltage $V_0$, which is applied to the thermal head 26 with respect to the other area 95*b* except for the edge area 95*a*. When the decision is NO at the step S81, namely when it is judged that the apparatus stands in a printing situation that the line of the top coat layer is not applied to the edge area 95*a*, the process is advanced to the step S84 and the printing of the top coat layer is started with the voltage applied to the thermal head 26 set to a usual value $V=(V_0)$.

The printing or thermal transfer of the top coat layer is completed by repeating the process of printing until the final line (step S83)

The third embodiment supplies, to the thermal head 26 during the application of the top coat layer to the edge area 95*a* corresponding to the vicinity of the edge of the recording paper in the direction perpendicular to the conveying direction, an energy greater than an energy supplied to the thermal head 26 with respect to the area 95*b* other than the edge area 95*a*. Thus, the transfer of heat even near the opposite sides of the recording paper is effected perfectly and the top coat transfer is satisfactorily attained.

Fourth Embodiment

The fourth embodiment is so designed such that the energy supplied to the thermal head during the application of the top coat layer to the edge area corresponding to the vicinity of the edge of the recording paper in the direction perpendicular to the conveying direction is greater than the energy supplied during the application of the top coat layer to the area other than the edge area, similarly to the third embodiment. The fourth embodiment differs from the third embodiment in respect that the application duration of the voltage for one line of the top coat layer is applied longer than usual for the purpose of increasing the energy supplied to the thermal head 26 during the application of the top coat layer to the edge area. The construction of the thermal transfer recording apparatus and the system of controlling the thermal head in this embodiment are identical with those of the second embodiment and will be omitted from the description.

First, the operation of printing the top coat layer under the printing situation as illustrated in FIG. 22, will be described below, provided that the image data of the top coat layer of one line corresponding to the sections taken on line the V—V line and the W—W line of FIG. 22 is identical with that of the third embodiment as illustrated in FIG. 23 and FIG. 24.

Figure 27A:
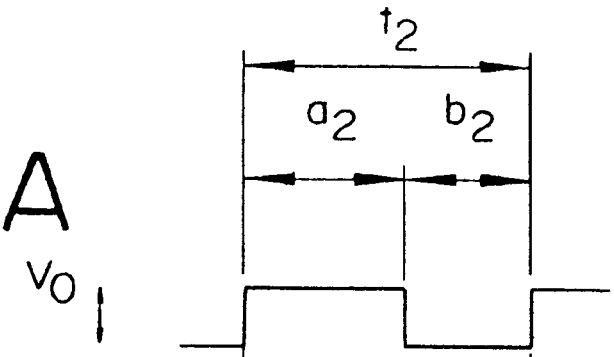
FIG. 27A is a time chart illustrating the voltage, which is applied to a heating element of a thermal head in an apparatus according to the fourth embodiment, corresponding to the image data of the white zone shown in FIG. 23 and FIG. 24.
Figure 27B:
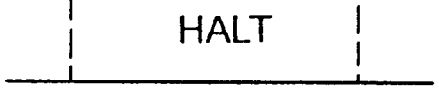
FIG. 27B is a time chart illustrating the voltage, which is applied to the heating element of the thermal head in the apparatus according to the fourth embodiment, corresponding to the image data of the hatched zone shown in FIG. 23 and FIG. 24.
Figure 27C:
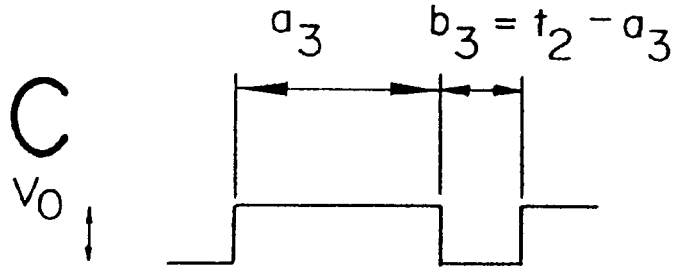
FIG. 27C is a time chart illustrating the voltage, which is applied to the heating element of the thermal head in the apparatus according to the fourth embodiment, corresponding to the image data of the black zone shown in FIG. 24.

FIG. 27A–FIG. 27C are time charts illustrating the voltage, which is applied to the thermal head of the apparatus according to the fourth embodiment, FIG. 27A representing the voltage applied to the heating element of the thermal head corresponding to the image data of the white zones 93*a* and 93*d* shown in FIGS. 23 and 24, FIG. 27B representing the voltage applied to the thermal head corresponding to the image data of the hatched zone 93*b* shown in FIGS. 23 and 24, and FIG. 27C representing the voltage applied to the thermal head corresponding to the image data of the black zone 93*c* shown in FIG. 24.

The embodiment controls the supplied energy E, based on the application duration t of the voltage. Thus, the application duration $a_3$ of voltage to the thermal head 26 with respect to the edge area 95*a* is so set, in connection with the relation, $E=(V^2/R)\times t$, as to satisfy the formulas, $a_3=a_2+\Delta t$ and $a_2/5 \leqq \Delta t \leqq a_2$, wherein a2 stands for the application duration of voltage to the thermal head 26 with respect to the other area 95*b* except for the edge area 95*a*. The usual voltage $V_0$ is applied to the thermal head 26.

The apparatus decides the application duration of the voltage, which is applied to respective heating elements in one line, based on the image data (printing situation) of the top coat layer, and then, print the top coat layer.

The embodiment faultlessly effects the transfer of heat even near the opposite sides of the recording paper and attains the improved top coat transfer, similarly to the third embodiment.

Fifth Embodiment

Figure 28:
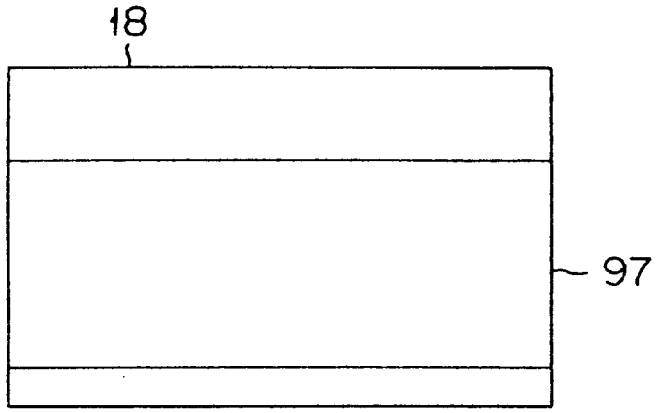
FIG. 28 is a diagram illustrating an example of printing the top coat layer by means of a thermal transfer recording apparatus according to the fifth embodiment.

FIG. 28 is a diagram illustrating an example of the printing of the top coat layer in a thermal transfer recording apparatus according to the fifth embodiment of this invention.

The fifth embodiment differs from the third and the fourth embodiments in respect that the larger energy than usual is supplied to the thermal head 26 consecutively during the application of the top coat layer to the whole area of the line including the edge area in the direction perpendicular to the conveying direction of the recording paper 18. The reference numeral "97" represents the printing area of the top coat layer. The method for supplying the larger energy can be specifically selected between increasing the voltage for application and elongating the application duration, similarly in the third or the fourth embodiment. The arrangement enables the top coat transfer near the opposite sides of the recording paper to be perfectly effected by a simple control.

Sixth Embodiment

Figure 29:
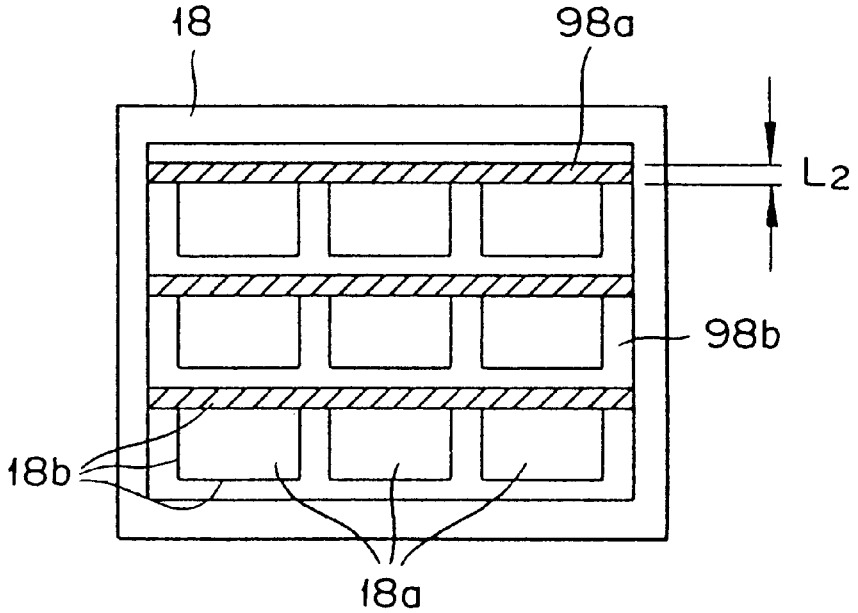
FIG. 29 is a diagram illustrating an example of printing the top coat layer by means of a thermal transfer recording apparatus according to the sixth embodiment.

FIG. 29 is a diagram illustrating an example of the printing of the top coat layer in a thermal transfer recording apparatus according to the sixth embodiment of this invention.

The sixth embodiment is applied to the recording paper 18 as a recording medium, which is possessed of the half-cut line 18*b* as illustrated in FIG. 29. Namely, the sixth embodiment is designed such that the energy, which is supplied to the thermal head 26 during the application of the top coat layer to an area 98*a* corresponding to the neighborhood of a half-cut line 18*b*, is larger than the energy, which is supplied to the thermal head 26 in respect with the other area 98*b* except for the area 98*a*, when the top coat layer of an ink film for covering the recording paper is transferred at the final stage of printing.

This embodiment is designed such that the energy, which is larger than the energy supplied to the thermal head 26 with respect to the area 98*b*, is supplied to the thermal head 26 with respect to the area 98*a* corresponding to the neighborhood of the half-cut line 18*b* positioned immediately before the image area, namely in the upstream in the direction of printing, except for the case in which the half-cut line 18*b* intersects perpendicularly the line of arrangement of the heating elements of the thermal head 26. Specifically, the larger energy than usual is supplied to the thermal head 26 during the application of the top coat layer to the area 98*a* corresponding to the zone from the point directly preceding the image area by a suitable length through the half-cut line 18*b*. The larger energy is not particularly supplied to the thermal head with respect to the top coat layer corresponding to the neighborhood of the half-cut line 18*b* positioned directly behind the image area, namely in the downstream in the direction of printing. Because the difference of supplied voltage has no effect on the image area. The construction of the thermal transfer recording apparatus and the system of controlling the thermal head in this embodiment are identical with those of the second embodiment and will be omitted from the description.

The term "half-cut thickness line" as used in this specification means the part which is so formed preparatorily as to be easily cut. Specifically, it refers to the part, which is halfway cut in thickness, or which has perforations.

The embodiment retains the temperature of the thermal head at a level appropriate for the top coat transfer during the printing of the image area behind the half-cut line by means of supplying the larger energy than usual to the thermal head 26 immediately before the image area.

The present embodiment adopts the method of setting the voltage applied to the thermal head 26 being a higher than usual for increasing the energy supplied to the thermal head 26 with respect to the area 98*a* corresponding to the neighborhood of the half-cut line 18*b* immediately preceding the image area.

Figure 30A:
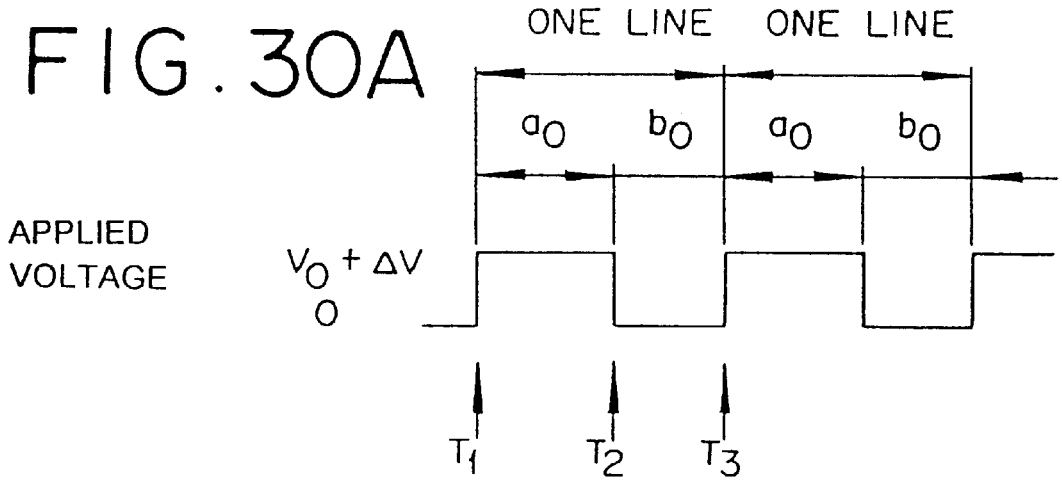
FIG. 30A is a time chart illustrating the voltage, which is applied to a thermal head in the apparatus according to the sixth embodiment, during the application of the top coat layer to the area of a recording paper in the neighborhood of a half-cut line immediately before the image area.
Figure 30B:
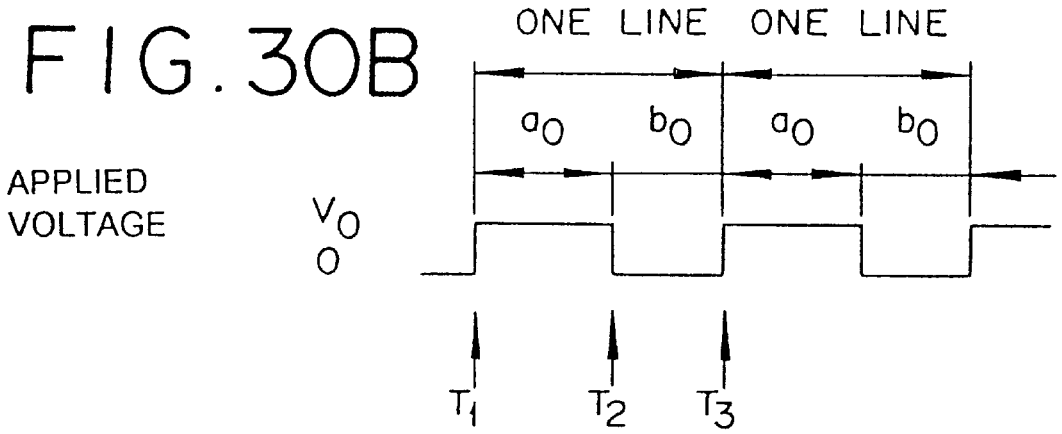
FIG. 30B is a time chart illustrating the voltage, which is applied to the thermal head in the apparatus according to the sixth embodiment, during the application of the top coat layer to the area excepting the area of a recording paper in the neighborhood of a half-cut line immediately before the image area.

FIG. 30A and FIG. 30B are time charts illustrating the voltage applied to the thermal head; FIG. 30A representing the voltage applied to the thermal head with respect to the top coat layer corresponding to the neighborhood of the half-cut line directly preceding the image area and FIG. 30B representing the voltage applied to the thermal head with respect to the top coat layer corresponding to the area other than the neighborhood.

The apparatus repeats the control of applying the voltage over the duration $a_0$ [ms] and then halting the application of the voltage over the duration $b_0$ [ms] on each of the lines of the top coat layer. The present embodiment is designed such that the energy E, which is supplied to the thermal head with respect to the area 98*a* corresponding to the neighborhood of the half-cut line directly preceding the image area, is set to satisfy the formulas, $E=E_0+\Delta E$ and $\frac{1}{2}\leqq\Delta E/E_0\leqq 1$, wherein $E_0$ stands for the energy, which is supplied to the thermal head with respect to the area 98*b* other than the area 98*a*. The lower limit of the range for $\Delta E/E_0$ is required for infallibly transferring the top coat layer to the recording paper. The upper limit is required for preventing the thermal energy generated by the thermal head from excessively increasing to the extent of ultimately inducing fast adhesion between the film after the top coat transfer and the recording paper, and allowing infallible separation.

Incidentally, the supplied energy E is expressed by the formula, $E=(V^2/R)\times t$, wherein V stands for the voltage applied to the thermal head, R for the resistance of the thermal element of the thermal head, and t for the time of the application of the voltage. When the supplied energy E is controlled with the applied voltage V, the formula, $\frac{1}{2}\leqq\Delta E/E_0\leqq 1$, may be modified to the formula, $(3/2)\times E_0\leqq E_0+\Delta E\leqq 2\times E_0$. Further, the formula may be modified to the formula, $(3/2)\times V_0^2\leqq(V_0\Delta V)^2\leqq 2\times V_0^2$, and $(3/2)^{1/2}\times V_0\leqq(V_0+\Delta V)\leqq 2^{1/2}\times V_0$.

The present embodiment is designed such that the voltage E, which is applied to the thermal head with respect to the area 98*a* corresponding to the neighborhood of the half-cut line 18*b* directly preceding the image area, is set to satisfy the formulas, $V=V_0+\Delta V$ and $V_0\times(-1+(3/2)^{1/2})\leqq\Delta V\leqq V_0\times(-1+2^{1/2})$, wherein $/V_0$ stands for the voltage, which is applied to the thermal head 26 with respect to the area 98*b* other than the area 98*a*.

The apparatus applies the larger energy than usual to the thermal head 26 with respect to the area 98*a* corresponding to the zone from the point directly preceding the image area by a suitable length through the half-cut line 18*b*. The length has its own allowable maximum that depends on the shape and the size of the image area relative to the whole area. And the length is set being about 2 mm, which is a length not exceeding the maximum.

The embodiment is designed such that the energy, which is supplied to the thermal head 26 with respect to the top coat layer corresponding to the neighborhood of the half-cut line directly preceding the image area, is the same as the usual energy, which is supplied to the thermal head 26 with respect to the area other than the neighborhood of the half-cut line when the temperature detected by the thermistor thermometer (not shown) fitted to the thermal head 26 exceeds 45° C. The film after the top coat transfer will possibly adhere to the recording paper, and will not be smoothly separated if the thermal energy generated by the thermal head increases excessively, So long as the detected temperature exceeds 45° C., the top coat transfer can be fully satisfactorily effected even when the voltage applied to the thermal head 26 is on the usual level.

Next, the operation of printing the top coat layer in the thermal transfer recording apparatus according to the, sixth embodiment will be described below with reference to the flow chart shown in FIG. 31.

First, the shape and the size of the image area are set by way of preparation. The setting is constant where the image area is fixed. The input of the shape and the size of the image area may be attained, for example, by means of transmission of image information. The data processing unit, which decides the area to which the larger energy is supplied, on the basis of the shape and the size of the image area and generates image data, produces one line after another of the image data of the top coat layer. As respects the printing, the top coat layer is thermally transferred by the same procedure as the yellow ink layer, magenta ink layer, or cyan ink layer as described previously.

Figure 31:
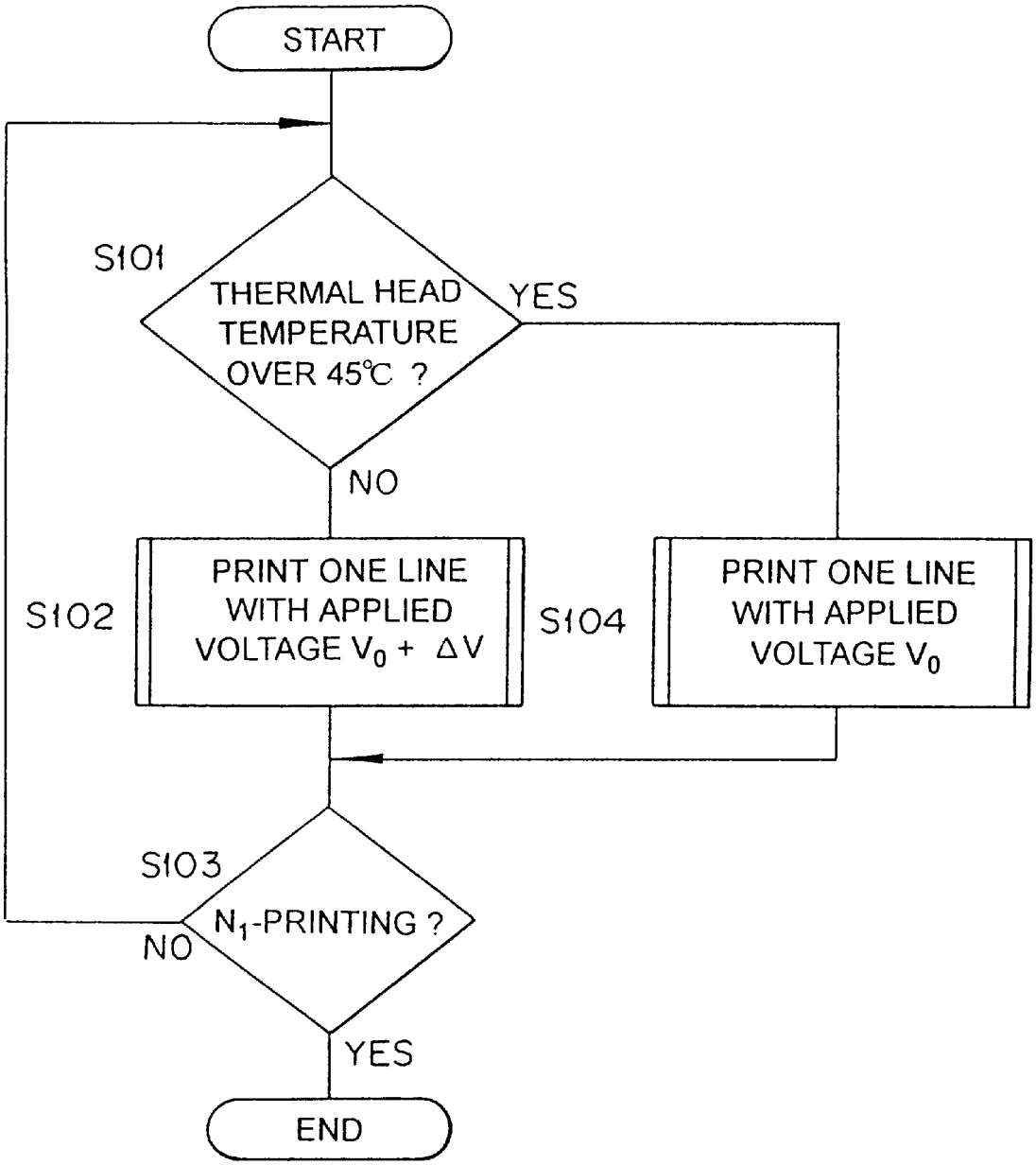
FIG. 31 is a flow chart of the operation of printing the top coat layer in the sixth embodiment.

FIG. 31 illustrates the flow chart of the printing operation from the time that the top coat transfer reaches the area to which the larger energy than usual is applied, namely the area ($L2=N_1$[mm]) immediately preceding the image area First, it is judged whether or not the temperature detected by the thermistor thermometer fitted to the thermal head exceeds 45° C. (step S101). The process advances to the next step S102 when the judgment is negative. At this step S102, one line of the top coat layer is transferred with the larger voltage than usual. Specifically, one line of the top coat layer corresponding to the area 98*a* with the length $N_1$ [mm] from the point immediately preceding the image area to the half-cut line 18*b* is transferred with the voltage $V=(V_0+\Delta V)$, which is larger by $\Delta V$ than the voltage $V_0$ applied to the thermal head 26 with respect to the area 98*b* other than the area 98*a* (step S102). The subroutine according to step S102 is the same as in illustrated in FIG. 15 and will be omitted from the following description.

The printing process with the applied voltage $V=(V_0+\Delta V)$ is repeated (steps S101–S103) unless a temperature detected by the thermistor thermometer fitted to the thermal head exceeds 45° C. (NO at step S101), and unless the length from the starting point which the larger energy is supplied reaches $N_1$ [mm], namely, the top coat transfer reaches the half-cut line immediately preceding the image area (NO at step S103).

The apparatus supplies the larger energy than usual to the thermal head 26 with respect to the area 98*a* in the neighborhood of the half-cut line immediately preceding the image area. The apparatus retains the temperature of the thermal head 26 at a level appropriate for the top coat transfer during the printing of the image area subsequent to the half-cut line, and improves the top coat transfer.

When it is judged at the step S101 that the temperature detected by the thermistor thermometer exceeds 45° C., the process advances to the step S104. At this step S104, one line of the top coat layer is transferred with the usual applied voltage. Specifically, this transfer is effected by the same usual voltage $V_0$ which is applied to the thermal head 26 with respect to the area 98*b* other than the area 98*a* corresponding to the length $N_1$ [mm] from the point immediately preceding the image area to the half-cut line 18*b*. Incidentally, the subroutine according to step S104 is the same as in FIG. 16 and will be omitted from the following description.

As a result, the apparatus avoids the possibility that the thermal energy generated by the thermal head will increase excessively and the film after the top coat transfer will adhere fast to the recording paper. And the apparatus performs the top coat transfer fully satisfactorily so long as the detected temperature exceeds 45° C.

The operation of printing in the length $N_1$(mm) from the point immediately preceding the area to the half-cut line 18*b* is completed when it is repeated that the one line is printed with the applied voltage V ($=V_0+\Delta V$) (step S102), or the applied voltage $V_0$ (step S104), and the printing of the length $N_1$ [mm] is completed (YES at step S103). The printing operation is carried out each time the thermal head 26 arrives at the point $N_1$ [mm] immediately preceding the image area, and finally the printing of the top coat layer is brought to completion.

The thermal transfer recording apparatus of the sixth embodiment is designed such that the energy, which is supplied to the thermal head 26 during the application of the top coat layer to the area 98*a* corresponding to the neighborhood of the half-cut line 18*b* positioned in the immediate upstream of the image area in the direction of printing, is larger than the energy, which is supplied to the thermal head 26 with respect to the other area 98*b* except for the area 98*a*, with the exception of the case in which the half-cut line 18*b* intersects perpendicularly the line of arrangement of the heating elements of the thermal head 26. Accordingly, the apparatus retains the temperature of the thermal head at a level appropriate for the top coat transfer during the printing of the image area in the half-cut line, and improves the top coat transfer.

Further, the apparatus is designed such that the energy E, which is supplied to the thermal head 26 with respect to the area 98*a* corresponding to the neighborhood of the half-cut line 18*b* positioned in the immediate upstream of the image area in the direction of printing, is set to satisfy the formulas, $E=E_0+\Delta E$ and $\frac{1}{2}<\Delta E/E_0<1$, wherein $E_0$ stands for the energy, which is supplied to the thermal head 26 with respect to the area 98*b* other than the area 98*a*. The apparatus avoids the possibility that the thermal energy generated by the thermal head will increase excessively and the film after the top coat transfer will adhere fast to the recording paper, and heats the thermal head 26 up to the level appropriate for the top coat transfer within a small number of lines of the top coat layer, and keeps the level securely. Further, the apparatus is designed such that the voltage applied to the thermal head is set being the usual level when a temperature detected by the thermistor thermometer fitted to the thermal head exceeds 45° C. The apparatus secures the temperature appropriate for the transfer, and precludes the possibility that the film after the top coat transfer will adhere fast to the recording paper.

Seventh Embodiment

The seventh embodiment differs from the sixth embodiment in respect that the application duration of the voltage for one line of the top coat layer is set being a greater length than usual for the purpose of increasing the energy supplied to the thermal head 26 with respect to the area 98*a* corresponding to the neighborhood of the half-cut line immediately preceding the image area.

The controller 90 transmits exclusively the STB signal to the control circuit 91. Based on this signal, the control circuit 91 applies the voltage to the thermal head 26. This operation is identical with what is illustrated in the block diagram of FIG. 17 in the second embodiment. To be specific, the choice between applying and not applying the usual voltage $V_0$ to the thermal head 26 depends on the setting of the STB signal being H or at L.

Figure 32A:
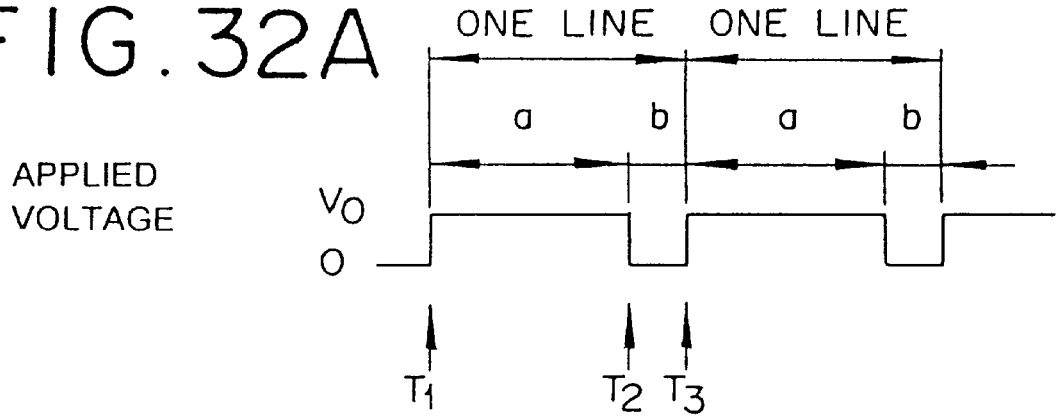
FIG. 32A is a time chart illustrating the voltage, which is applied to a thermal head in an apparatus according to the seventh embodiment, during the application of the top coat layer to an area of a recording paper in the neighborhood of a half-cut line immediately before the image area.
Figure 32B:
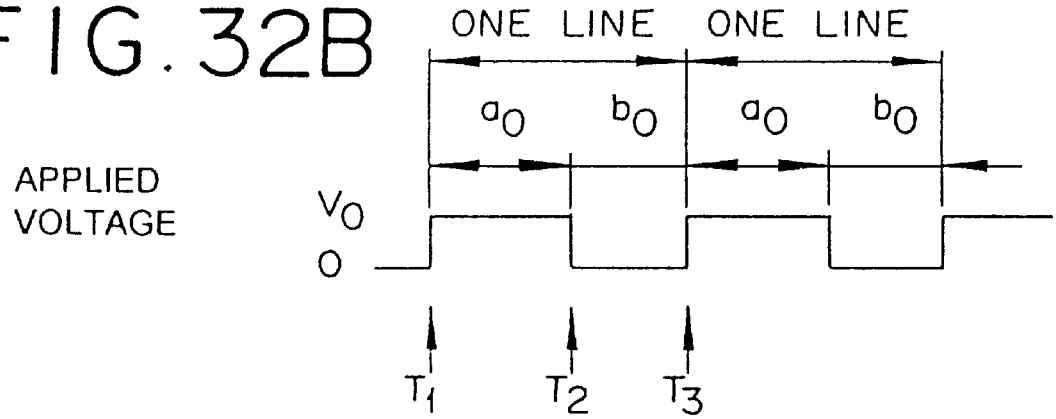
FIG. 32B is a time chart illustrating the voltage, which is applied to the thermal head in the apparatus according to the seventh embodiment, during the application of the top coat layer to the area excepting the area of a recording paper in the neighborhood of a half-cut line immediately before the image area.
Figure 33:
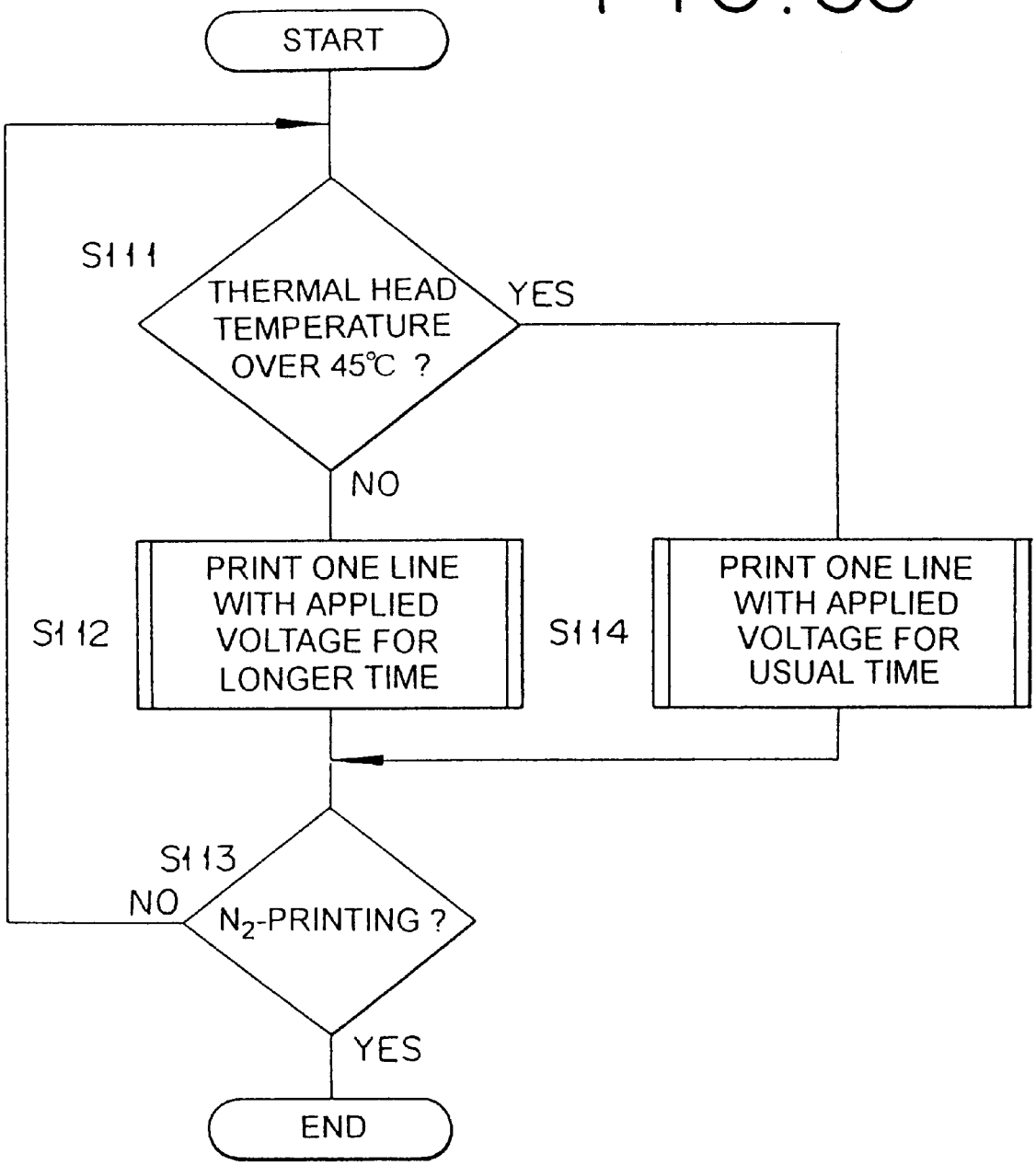
FIG. 33 is a flow chart of the operation of printing the top coat layer in the seventh embodiment.

FIG. 32A and FIG. 32B are time charts illustrating the voltage applied to the thermal head of the apparatus according to the second embodiment; FIG. 32A representing the voltage, which is applied to the thermal head during the application of the top coat layer to the area corresponding to the neighborhood of the half-cut line immediately preceding the image area and FIG. 32B representing the voltage, which is applied to the thermal head with respect to the other area except for the area corresponding to the neighborhood of the half-cut line. FIG. 33 is a flow chart of the operation of printing the top coat layer in the apparatus according to the seventh embodiment.

Next, the operation of printing the top coat layer in the present embodiment will be described below with reference to FIG. 32A, FIG. 32B, and FIG. 33.

First, it is determined whether or not a temperature detected by the thermistor thermometer fitted to the thermal head exceeds 45° C. (step Sill). The process advances to the next step S112 when the determination produces a negative reply.

At the step S112, one line of the top coat layer is transferred with a longer application duration than usual. Namely, the apparatus applies, respecting the usual area 98*b*, the voltage over the duration $a_0$ [ms] per line, and halting the application of the voltage over the duration $b_0$ (FIG. 32B). And the apparatus applies, respecting the area 98*a* (FIG. 29) corresponding to the length $L_2=N_2$ [mm] from the point immediately preceding the image area to the half-cut line 18*b*, the voltage over the duration a [ms] per line, and halting the application of the voltage over the duration $b_0$ (FIG. 32A). The subroutine concerning the step S112 is substantially identical with what is illustrated in FIG. 10 and will be omitted from the following description.

The embodiment controls the supplied energy E based on the duration t of the application of the voltage. The duration a of the application of voltage to the thermal head 26 with respect to the initial area 98*a* for printing the top coat layer is, in connection with the relation, $E=(V^2/R)\times t$, set to satisfy the formulas, $a=a_0+\Delta t$ and $a_0/2\leqq\Delta t\leqq a_0$, wherein $a_0$ stands for the application duration of the voltage to the thermal head 26 with respect to the area 98*b* other than the initial area. The usual voltage, $V_0$, is applied to the thermal head 26.

The apparatus repeat the control of printing the one line with the applied voltage $V_0$ over the longer duration than usual (steps S111–S113) unless a temperature detected by the thermistor thermometer fitted to the thermal head exceeds 45° C. (NO at step S101) and unless the length from the starting point which the larger energy reaches $N_2$ [mm], namely, namely, the top coat transfer reaches the half-cut line immediately preceding the image area (NO at step S103).

When it is determined at step S111 that a temperature detected by the thermistor thermometer exceeds 45° C., the process advances to the step S114. At this step S114, one line of the top coat layer is transferred by the application of the voltage over the usual duration. Specifically, the apparatus applies the voltage over the duration $a_0$ [ms] per line and halts the application of the voltage over the duration $b_0$ [ms] (FIG. 32B). The subroutine according tot the step S114 is substantially identical with what is illustrated in FIG. 21 and will be omitted from the following description.

The apparatus repeats printing the one line with the application of the voltage over the longer duration than usual (step S112) or the usual duration (step S114). Consequently, the printing of the length $N_2$ [mm] is done (YES at step S113). Namely, the apparatus completes the operation of printing of the length $N_2$ [mm] from the point immediately preceding the image area to the half-cut line 18*b*. The apparatus repeats the operation of printing each time the thermal head 26 arrives at the starting point of the length $N_2$ [mm], immediately preceding the image area, and finally completes the printing of the top coat layer.

The apparatus applies greater energy than usual to the thermal head 26 by means of printing the one line with the voltage applied over the longer duration than usual with respect to the area 98*a* in the neighborhood of the half-cut line immediately preceding the image area. Thus, the apparatus keeps the temperature of the thermal head 26 at the level appropriate for the top coat transfer during the printing of the image area subsequent to the half-cut line, and improves the top coat transfer as effectively as in the sixth embodiment.

Eighth Embodiment

Figure 34:
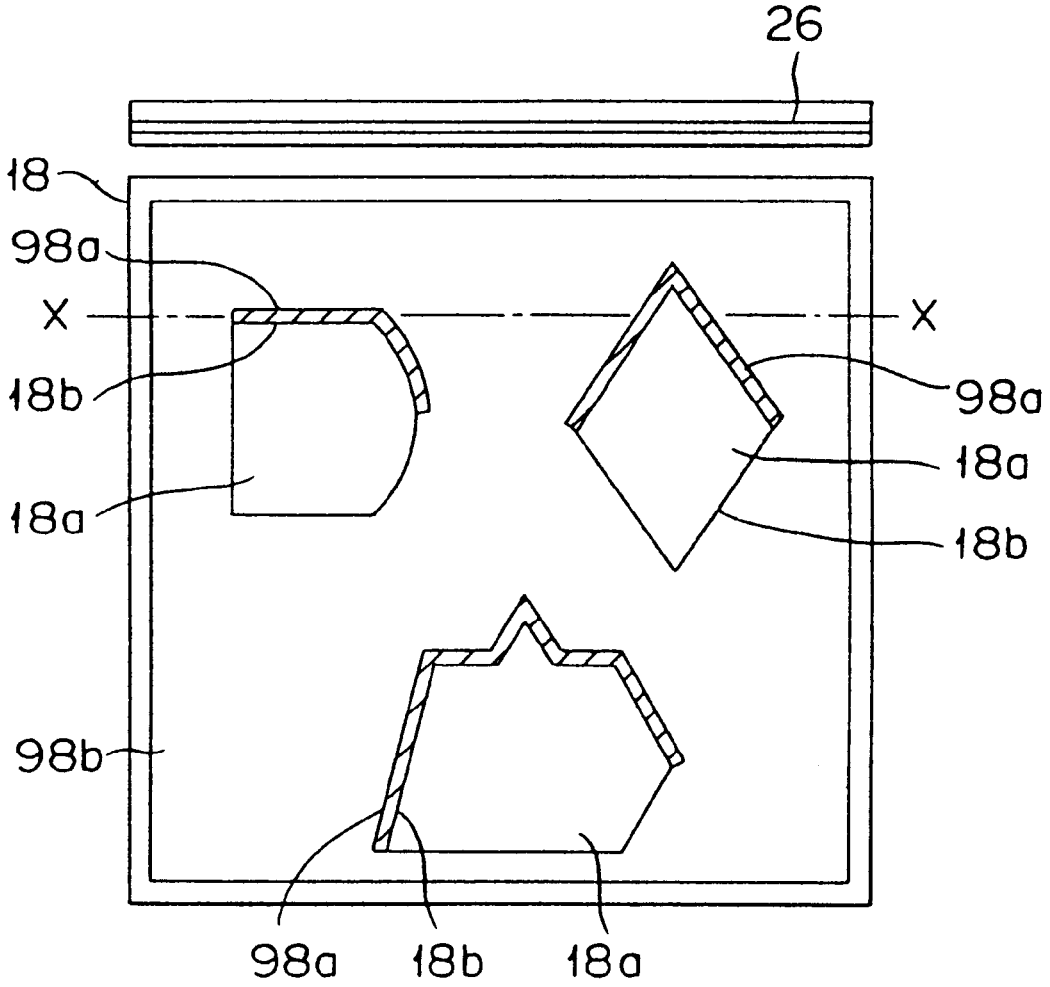
FIG. 34 is a diagram illustrating an example of printing the top coat layer in a thermal transfer recording apparatus according to the eighth embodiment, together with a thermal head.
Figure 35:
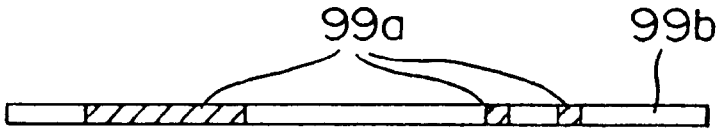
FIG. 35 is a diagram illustrating the image data of a top coat layer corresponding to a section taken on line X—X of FIG. 34.

FIG. 34 is a diagram illustrating an example of printing the top coat layer by the use of a thermal transfer recording apparatus according to the eighth embodiment together with the thermal head and FIG. 35 is a diagram illustrating the image data of the top coat layer corresponding to the section taken line X—X of FIG. 34.

The eighth embodiment sets the application duration of voltage being a greater length than usual for the purpose of increasing the energy applied to the thermal head 26. It, however, differs from the seventh embodiment in respect that heating elements are respectively set being individual application durations of voltage during the printing of the one line. When the image area 18*a* assume such arbitrary shapes as are illustrated in FIG. 34, the apparatus requires increased energy, which is supplied to the thermal head 26 during the application of the top coat layer to the area 98*a* in the neighborhood of the half-cut lines 18*b* immediately preceding the image area 18*a*, namely only with respect to the zones indicated by hatched lines in the diagram, with the exception of the case in which the line of arrangement of heating elements of the thermal head 26 perpendicularly intersects the half-cut lines 18*b*. The eighth embodiment severally fixes, with the control circuit 91, the durations of application of the voltage for the individual heating elements and expresses a gradient of tone in terms of the application duration.

For example, FIG. 35 illustrates the image data of the top coat layer corresponding to the section taken line X—X of FIG. 34. In the diagram, the image data 99*a* in the hatched zone indicates the application of the larger energy than usual, and the image data 99*b* in the other zone indicates the application of the usual energy. In this manner, the image data of the top coat layer is produced with respect to each of the lines.

Figure 36A:
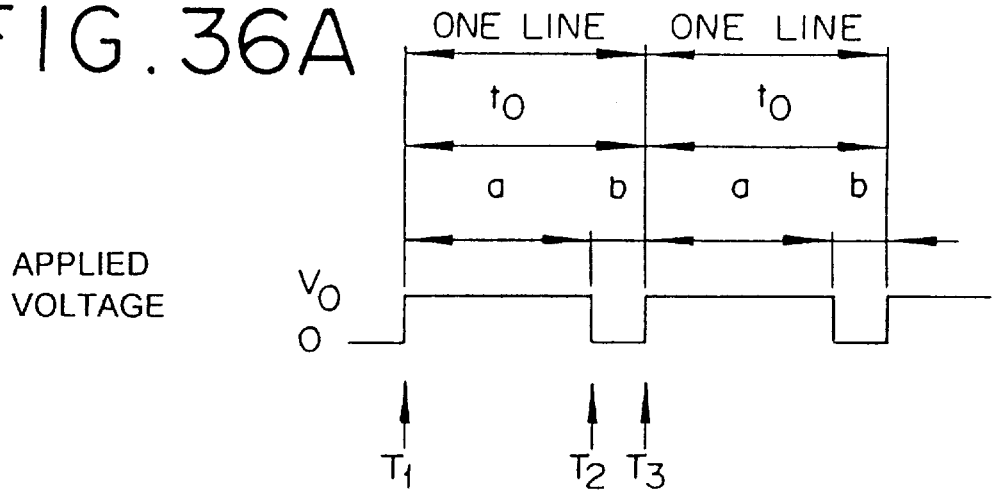
FIG. 36A is a time chart illustrating the voltage, which is applied to a heating element of the thermal head in the apparatus of the eighth embodiment, corresponding to the hatched zone of the image data shown in FIG. 35.
Figure 36B:
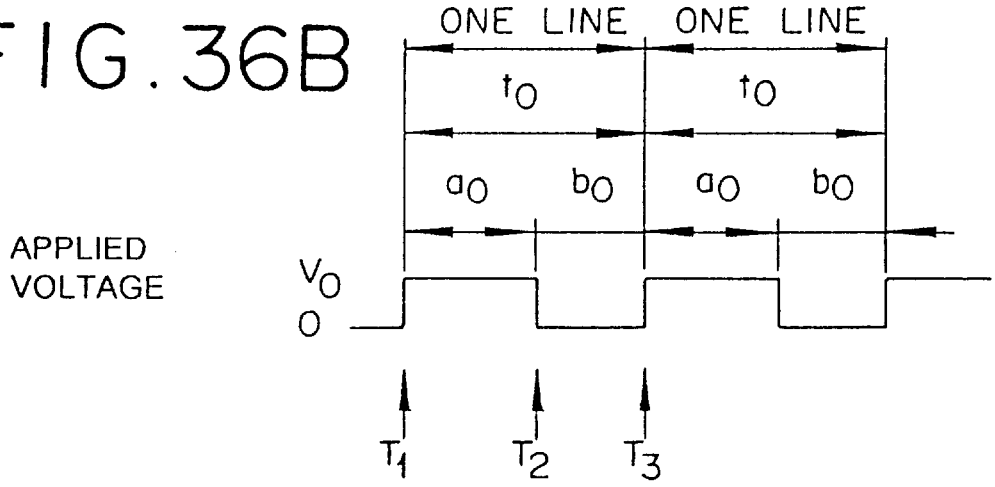
FIG. 36B is a time chart illustrating the voltage, which is applied to the heating element of the thermal head in the apparatus of the eighth embodiment, corresponding to the zone excepting the hatched zone of the image data shown in FIG. 35.

FIG. 36A and FIG. 36B are time charts illustrating the voltage applied to the thermal head of the apparatus according to the eighth embodiment; FIG. 36A representing the voltage, which is applied to the heating elements of the thermal head with respect to the hatched zones 99*a* of the image data shown in FIG. 35, and FIG. 36B representing the voltage, which is applied to the heating elements of the thermal head with respect to the other zones 99*b*.

The top coat transfer is attained by applying the voltage to the heating elements with respect to the hatched zones 99*a* of FIG. 35 over the longer durations than usual. To be specific, it is repeated on the zones 99*b* other than the hatched zones of FIG. 35 that the voltage is applied over the duration $a_0$ [ms] and the application of the voltage is halted over the duration $b_0$ [ms] with respect to the one line (FIG. 36B). And it is repeated on the heating elements corresponding to the hatched zones 99*a* of FIG. 35 that the voltage is applied over the duration a [ms], which is larger than the duration of as and the application of the voltage is halted over the duration $b_0$ [ms] with respect to the one line (FIG. 36A) in this case, it is requires to satisfy the formula, $t_0=a_0+b_0=a+b$, wherein $t_0$ stands for the duration of printing the one line.

The present embodiment transfers one line of the top coat layer with the application of voltage over the usual duration similarly to the seventh embodiment when the usual voltage $V_0$ is applied to the thermal head 26 and a temperature detected by the thermistor thermometer fitted to the thermal head exceeds 45° C., Even with respect to the image area 18*a* having such arbitrary shapes as are illustrated in FIG. 34, the eighth embodiment sets the energy, which is supplied to the thermal head 26 during the application of t he top coat layer to the area 98*a* in the neighborhood of the half-cut lines 18*b* immediately preceding the image area 18*a*, namely the hatched zones in the diagram, being greater than the energy, which is supplied to the thermal head 26 with respect to the other area except for the are 98*a*, with the exception of the case in which the line of arrangement of heating elements of the thermal head 26 perpendicularly intersects the half-cut lines 18*b*. Thus, the eighth embodiment improves the top coat transfer on the Image area 18*a*.

The embodiments of the present invention have described the transfer of the initial area of the top coat layer, the transfer of the edge area corresponding to the vicinity of the lateral edge of the recording paper, and the transfer in the image area subsequent to the half-cut lines with reference to various examples. However, it is only natural that this invention allows construction of recording apparatuses, which are capable of performing treatments suitably combining the embodiments.

There have been shown and described present preferred embodiments of the invention. But, it is to be distinctly understood that the invention is not limited thereto but may be otherwise variously embodied and practiced by any person of ordinary skill in the art.

The entire disclosure of Japanese Patent Applications No. 08- 273605 filed on Oct. 16, 1996 and No. 08-288305 filed on Oct. 30, 1996 and No. 09-140589 filed on May 29, 1997, which respectively including the specification, claims, drawings and summary is incorporated herein by reference in its entirety.

What is claimed is:

1. A thermal transfer recording apparatus for thermally transferring a transparent film as a top coat layer to an image-formed surface of a recording paper, the apparatus comprising:

a thermal head to generate heat in proportion to a supplied control signal;

a temperature sensor to measure a temperature of said thermal head and output a detection signal corresponding to a measured temperature; and a control unit, responsive to said detection signal, to output a plurality of control signals to said thermal head during an application of film to an area of said image-formed surface of said recording paper, wherein said control unit outputs a first control signal for an initial portion, as a portion for starting said application of film, of said area and outputs a second control signal for a remaining portion of said area, said first control signal effecting a greater generated heat from said thermal head than said second control signal.

2. An apparatus according to claim 1, wherein energy E, which represents an energy that is generated by said thermal head during said application of film to said initial portion of said area of said recording paper, satisfies the following formulas:

$$E=E_0+\Delta E$$

$$\tfrac{1}{2}<\Delta E/E_0<1$$

where, $E_0$ represents energy that generated by said thermal head during an application of film to said remaining portion of said area, and $\Delta E$ represents a difference between energy generated by said thermal head during an application of film to said initial portion of said area and energy generated by said thermal head during said application of film to said remaining portion of said area.

3. An apparatus according to claim 2, wherein said initial portion of said area of said recording paper extends for a length not exceeding 2 mm from a thermal head transfer start position relative to said recording paper.

4. An apparatus according to claim 3, wherein said control unit causes said thermal head to generate energy $E_0$ when a measured temperature of said thermal head reaches a prescribed temperature during said application of film to said initial portion of said area of said recording paper.

5. A thermal transfer recording apparatus for thermally transferring a transparent film as a top coat layer to an image formed surface of a recording paper, said apparatus comprising:

a thermal head that is adapted to generate heat in proportion to a supplied energy;

a conveying device which conveys said recording paper in a conveying direction relative to said thermal head; and a control unit to keep said supplied energy under control such that energy supplied during an application of said film to an initial area of said recording paper is greater than energy supplied during an application of said film to a remaining area of said recording paper, wherein said initial area includes at least an edge of said recording paper extending in a direction parallel to said conveying direction of said recording paper.

6. An apparatus according to claim 5, wherein a length of said initial area, which extends in a direction perpendicular to said conveying direction of said recording paper, is within 2 mm from said edge of said recording paper.

7. An apparatus according to claim 5, wherein energy E, which represents an energy that is generated by said thermal head during an application of film to said initial area of said recording paper, satisfies the following formulas:

$$E=E_0+\Delta E$$

$$\tfrac{1}{5}<\Delta E/E_0<1$$

where, $E_0$ represents energy that is generated by said thermal head during an application of film to said remaining area, and $\Delta E$ represents a difference between energy generated by said thermal head during said application of film to said initial area of said recording paper and energy generated by said thermal head during said application of film to said remaining area of a recording paper.

8. An apparatus according to claim 7, wherein a length of said initial area, which extends in a direction perpendicular to said conveying direction of said recording paper, is within 2 mm from said edge of said recording paper.

9. An apparatus according to claim 7, further comprising a temperature sensor to measure a temperature of said thermal head and output a detection signal corresponding to a measured temperature, wherein said control unit is responsive to said detection signal output from said temperature sensor.

10. An apparatus according to claim 9, wherein said control unit is adapted to cause said thermal head to generate energy $E_0$ when a measured temperature of said thermal head equals a prescribed temperature during said application of film to said initial area of said recording paper.

11. A thermal transfer recording apparatus for thermally transferring a film as a coating layer to a surface of a recording paper having at least one half-cut thickness line, the apparatus comprising:

a thermal head with a plurality of linearly arranged heating elements that are adapted to generate heat in proportion to a supplied control signal;

a conveying device that conveys a recording paper relative to said thermal head; and a control unit that outputs a plurality of control signals to said thermal head such that a first control signal output to said thermal head during an application of film to at least one initial area of said recording paper effects a greater generated heat from said thermal head than a second control signal output for all non-initial area(s) of said recording paper, wherein each initial area includes a half-cut thickness.

12. An apparatus according to claim 11, wherein energy E, which represents an energy that is generated by said thermal head during said application of film to said at least one initial area of said recording paper, satisfies the following formulas:

$$E=E_0+\Delta E$$

$$\frac{1}{2}<\Delta E/E_0<1$$

where, $E_0$ represents energy that is generated by said thermal head during an application of said film to said remaining area(s), and $\Delta E$ represents a difference between energy generated by said thermal head during said application of film to said at least one initial area of said recording paper and energy generated by said thermal head during said application of film to said all non-initial areas of said recording paper.

13. An apparatus according to claim 12, wherein said control unit is adapted to output said second control signal to said thermal head when said linearly arranged heating elements perpendicularly intersect a half-cut thickness line.

14. An apparatus according to claim 12, wherein said thermal head includes a temperature sensor that measures a temperature of said thermal head and outputs a detection signal corresponding to a measured temperature, wherein said control unit is responsive to said detection signal output from said temperature sensor.

15. An apparatus according to claim 14, wherein said control unit is adapted to cause said thermal head to generate energy $E_0$ when a measured temperature of said thermal head equals prescribed temperature during said application of film to said respective initial areas of said recording paper.

16. A thermal transfer recording apparatus for thermally transferring a transparent film as a top coat layer to an image formed surface of a recording paper, the apparatus comprising:

a thermal head that is adapted to generate heat in proportion to a supplied voltage; and a control unit to control a characteristic of said supplied voltage such that a voltage supplied during an application of film to a prescribed initial portion of an area of a recording paper is greater than a voltage supplied during an application of film to a remaining portion of said area of said recording paper, wherein said characteristic of said supplied is voltage is selected from a group consisting of a pulse duration and a voltage amplitude.

* * * * *